US005184309A

United States Patent [19]

Simpson et al.

[11] Patent Number: 5,184,309

[45] Date of Patent: Feb. 2, 1993

[54] FLUID DISPENSING NOZZLE INCLUDING IN LINE FLOW METER AND DATA PROCESSING UNIT

[75] Inventors: W. Dwain Simpson, Wilton; James H. Pyle, Weston, both of Conn.

[73] Assignee: Saber Equipment Corp., Stratford, Conn.

[21] Appl. No.: 496,219

[22] Filed: Mar. 20, 1990

[51] Int. Cl.[5] ..... B67D 5/22

[52] U.S. Cl. ..... 364/510; 141/392

[58] Field of Search ..... 364/509, 510, 550, 465; 141/198, 208, 210, 217, 392; 340/606, 608; 377/21; 222/23, 40; 285/1-4

[56] References Cited

U.S. PATENT DOCUMENTS

| | | | |
|---|---|---|---|
| 2,528,697 | 11/1950 | Logan et al. | 226/127 |
| 2,918,095 | 12/1959 | Shawhan | 141/210 |
| 2,955,725 | 10/1960 | Niederst | 222/23 X |
| 3,205,922 | 9/1965 | Davis et al. | 141/209 |
| 3,259,154 | 7/1966 | Scherer | 141/209 |
| 3,341,075 | 9/1967 | Boudot et al. | 222/70 |
| 3,370,623 | 2/1968 | Murray | 141/206 |
| 3,380,491 | 4/1968 | Rosell et al. | 141/209 |
| 3,521,680 | 7/1970 | Wood et al. | 141/209 |
| 3,542,092 | 11/1970 | Budd et al. | 141/209 |
| 3,548,893 | 12/1970 | Moore et al. | 141/208 |
| 3,603,359 | 9/1971 | Belue | 141/208 |
| 3,638,689 | 2/1972 | Eklund | 141/214 |
| 3,653,415 | 4/1972 | Boudot et al. | 141/208 |
| 3,771,577 | 11/1973 | Mayer | 141/209 |
| 3,811,486 | 5/1974 | Wood | 141/208 |
| 3,911,973 | 10/1975 | Casteline, Jr. | 141/59 |
| 4,005,412 | 1/1977 | Leander | 340/380 |
| 4,023,601 | 5/1977 | Hansel | 141/207 |
| 4,027,708 | 6/1977 | Hansel | 141/209 |
| 4,031,930 | 6/1977 | Sutcliffe et al. | 141/207 |
| 4,033,389 | 7/1977 | Hansel et al. | 141/207 |
| 4,059,135 | 11/1977 | Hansel | 141/207 |
| 4,119,111 | 10/1978 | Allread | 285/2 |
| 4,121,635 | 10/1978 | Hansel | 141/207 |
| 4,125,139 | 11/1978 | Guertin et al. | 141/206 |
| 4,140,013 | 2/1979 | Hunger | 73/229 |
| 4,143,689 | 3/1979 | Conley et al. | 141/207 |
| 4,213,488 | 7/1980 | Pyle | 141/1 |
| 4,232,715 | 11/1980 | Pyle | 141/1 |
| 4,258,421 | 3/1981 | Juhasz et al. | 364/424 |
| 4,286,635 | 9/1981 | McMath | 141/98 |
| 4,331,187 | 5/1982 | Trygg | 141/218 |
| 4,336,830 | 6/1982 | Healy | 141/59 |
| 4,360,127 | 11/1982 | Maruyama et al. | 222/14 |
| 4,418,730 | 12/1983 | McMath | 141/207 |
| 4,449,545 | 5/1984 | Vernor et al. | 137/68.1 |
| 4,450,879 | 5/1984 | Wood | 141/209 |
| 4,453,578 | 6/1984 | Wilder | 141/209 |
| 4,490,798 | 12/1984 | Franks et al. | 364/550 |
| 4,559,982 | 12/1985 | Fink, Jr. | 141/206 |
| 4,572,255 | 2/1986 | Rabinovich | 141/217 |
| 4,617,975 | 10/1986 | Rabushka et al. | 285/2 X |
| 4,691,941 | 9/1987 | Rabushka et al. | 285/1 |
| 4,697,624 | 10/1987 | Bower et al. | 141/208 |
| 4,700,579 | 10/1987 | Hall | 73/861.78 |
| 4,709,735 | 12/1987 | Chang | 141/209 |
| 4,735,243 | 4/1988 | Ehlers | 141/218 |
| 4,750,130 | 6/1988 | Shimamura et al. | 364/465 |
| 4,796,678 | 1/1989 | Motohashi et al. | 141/206 |
| 4,797,820 | 1/1989 | Wilson et al. | 364/510 |
| 4,807,664 | 2/1989 | Wilson et al. | 364/420 X |
| 4,809,753 | 3/1989 | Fink, Jr. | 141/206 |
| 4,854,338 | 8/1989 | Grantham | 285/4 X |
| 4,899,792 | 2/1990 | Podgers | 285/2 X |
| 4,931,938 | 6/1990 | Hass | 364/510 |
| 4,934,419 | 6/1990 | Lamont et al. | 364/465 X |
| 4,951,224 | 6/1990 | Hokynar | 364/510 |
| 4,967,366 | 10/1990 | Kaehler | 364/465 |
| 5,018,546 | 5/1991 | Carmack et al. | 285/2 X |

FOREIGN PATENT DOCUMENTS

| | | | |
|---|---|---|---|
| 2230836 | 1/1974 | Fed. Rep. of Germany | 222/23 |
| 3438939 | 5/1986 | Fed. Rep. of Germany . | |
| 0358818 | 10/1931 | United Kingdom | 222/23 |
| 1393062 | 4/1973 | United Kingdom . | |
| 2174363A | 11/1986 | United Kingdom . | |

*Primary Examiner*—Parshotam S. Lall

*Assistant Examiner*—Michael Zanelli

[57] ABSTRACT

An improved apparatus for dispensing fuel and the like is disclosed including a display unit and a data processing system. Flow of fuel is montitored and the information relating to amount, price, etc., may be displayed on a display unit mounted directly on the nozzle. The moving mechanical parts such as the valve are readily separable from the outer handle of the nozzle so that if a customer inadvertently drives a vehicle away with the nozzle still inserted in the gasoline tank, the costly mechanical components of the valve are retained at the gasoline service station.

12 Claims, 17 Drawing Sheets 14
49
21
VALVE
22
CHECK VALVE
15
42
41
TRANSDUCER PRESSURE SWITCH
36
MAGNETIC CLUTCH COIL
52
TRIGGER SWITCH
29
RECHARGEABLE BATTERY
56
RECHARGING CIRCUIT (NOZZLE)
NOZZLE
HANGER
57
RECHARGING CIRCUITRY (HANGER)
58
A.C. POWER 34
37
35
36
32
33
39
31

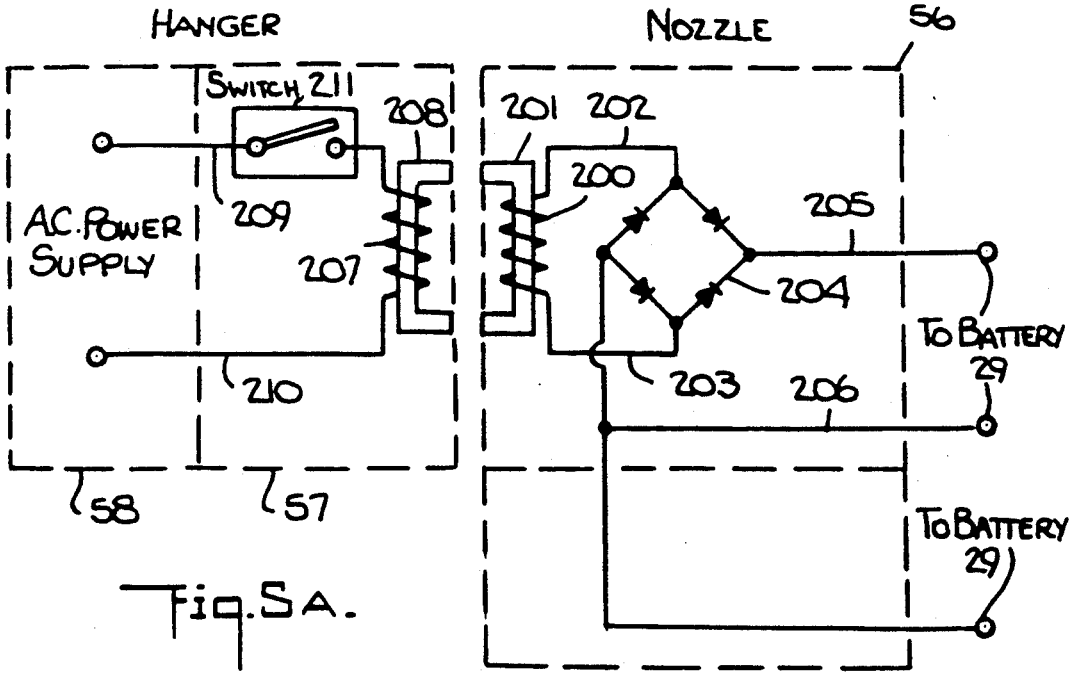
Fig. 5A.
Fig. 5B.
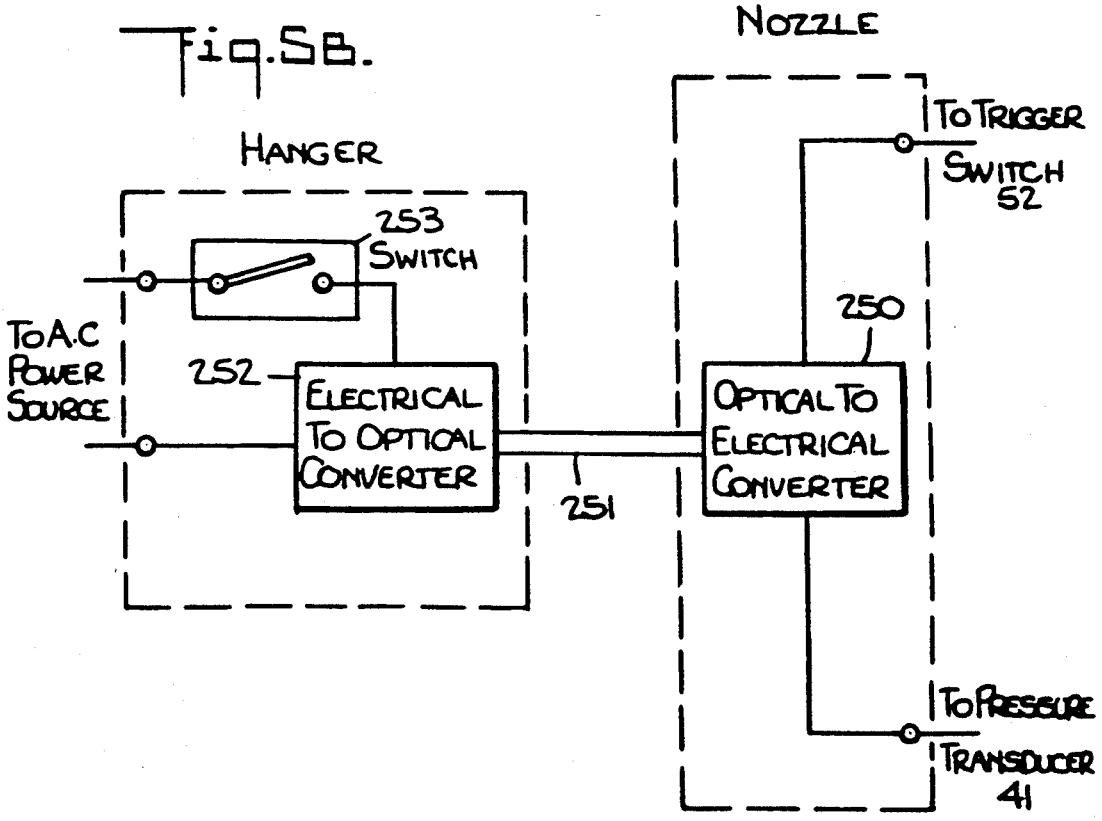

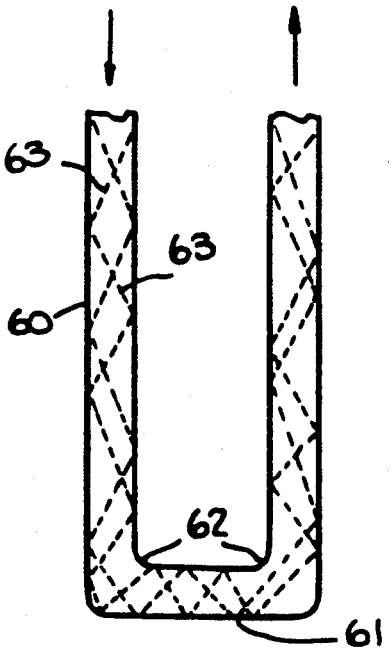
Fig. 8A.
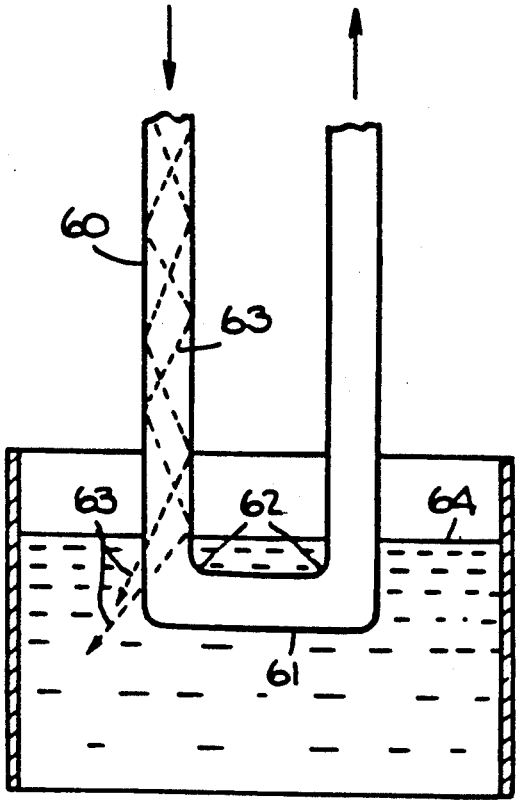
Fig. 8B.
Fig. 8C.
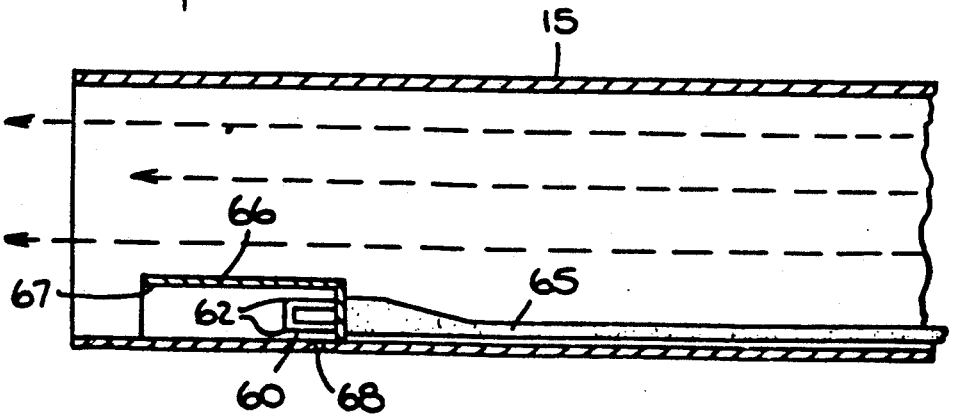

FLUID DISPENSING NOZZLE INCLUDING IN LINE FLOW METER AND DATA PROCESSING UNIT

FIELD OF THE INVENTION

The present invention is directed to a system for dispensing a fluid, such as gasoline and, more particularly, to a new and improved hand held fluid dispensing nozzle incorporating electrical flow controls, in-line, point-of-delivery flow metering and a flow information data processing device including an information display and interactive user controls for selecting, e.g. dispensing and payment options.

BACKGROUND OF THE INVENTION

Typically, in known commercial fuel dispensing systems, particularly of a retail gasoline dispensing facility, a mechanical nozzle device is utilized to dispense the fuel to the fuel tank of a motor vehicle. The nozzle is a mechanical device that operates solely to dispense the fuel. Accordingly, known fuel dispensing nozzles provide little or no functionality beyond a basic mechanical valve control of the fluid flow and require a user to move away from the point of delivery at the motor vehicle to engage in any other activities relating to the sale and purchase of fuel for the motor vehicle.

SUMMARY OF THE INVENTION

The present invention overcomes the shortcomings and disadvantages of known nozzles presently in commercial use by providing a hand held fuel dispensing nozzle having an in-line, point-of-delivery electronic fluid flow meter and a data processing unit coupled to the flow meter for input and processing of data related to the fluid flow through the nozzle. The data processing unit is also coupled to an information display device to provide pertinent information regarding fluid delivery directly to the user at the point delivery and is further coupled to interactive user controls mounted on the hand-held nozzle to enable the user to assert various commands relating to the use of the nozzle, such as input of a preselected amount of fuel to be dispensed and selection of a method of payment, also directly at the point of delivery. Both the information display device and interactive user controls can be mounted on the nozzle at a forward portion thereof such that they are in the user's line-of-sight when he or she is operating the nozzle to dispense fuel to afford maximum efficiency and effectiveness in the use of the nozzle.

A magnetic card reader can also be installed on the nozzle for input of customer and credit information, as a method of payment option. The present invention provides a nozzle having a wide range of functionality for accomodation of all activities relating to the purchase and sale of fuel, all at the point of delivery. Thus, the nozzle according to the present invention is particularly suitable for use in retail gasoline dispensing facilities, especially where the customer himself is the user.

Pursuant to one embodiment of the present invention, the data processing device is coupled to a communication interface that is, in turn, coupled to a remote location having a centralized monitoring and control system. The remote system can be coupled to a plurality of nozzles according to the present invention, installed throughout a retail facility, for centralized monitoring, control and data storage.

In addition, the nozzle according to the present invention includes a positive electrical or electromechanical actuation to open the main valve of the nozzle and a mechanical device operating to automatically shut down the main valve upon any interruption of electrical power to the main valve, e.g. a power interruption controllably actuated by the data processing unit, as for example, when a preselected amount of fluid has been dispensed through the nozzle.

A nozzle according to the present invention includes a remote source of electric power having an electrical-to-optical power converter coupled to the nozzle by optic fibers for safe transmission of power by light. In the alternative, the nozzle can be provided with a self-contained rechargeable battery and a magnetic coupling device removably magnetically coupled to a recharge connector that is arranged in the cradle used to mount the nozzle when the nozzle is not in use. In this manner, the battery can be continuously recharged between each use of the nozzle without the use of electric contacts. In either alternative, the electrical power made available at the nozzle can be used to power the data processing unit, magnetic card reader, information display and communication interface mounted within the nozzle to efficiently gather, display, process and transmit information relating to the fluid dispensed during each use of the nozzle and to energize electromechanical controls for the valve.

BRIEF DESCRIPTION OF THE DRAWINGS

FIG. 5*a* is a detail of a battery recharge circuit for use in the electrical system of FIG. 5, according to the present invention.

FIG. 5*b* illustrates an optical power source for the electrical system of FIGS. 2 and 5.

FIGS. 8*a* and 8*b* illustrate total internal reflection and fluid blockage of total internal reflection within a probe tip of the optical sensor driven switching circuit of FIG. 7.

FIG. 8*c* is a side cross-sectional view of an optical probe tip according to the present invention mounted within a nozzle spout.

DETAILED DESCRIPTION

Figure 1:
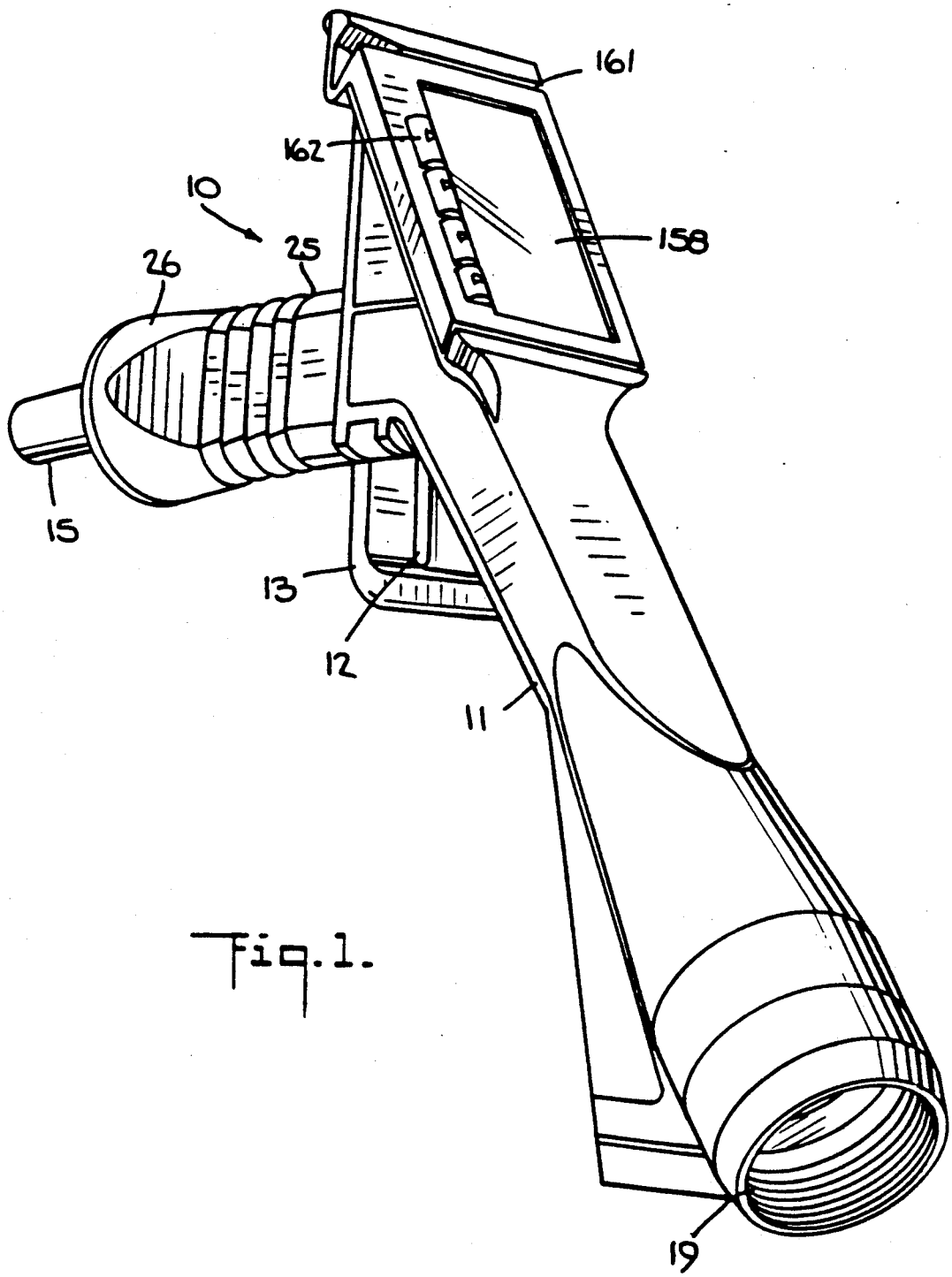
FIG. 1 is a perspective view of a nozzle according to the present invention.
Figure 1A:
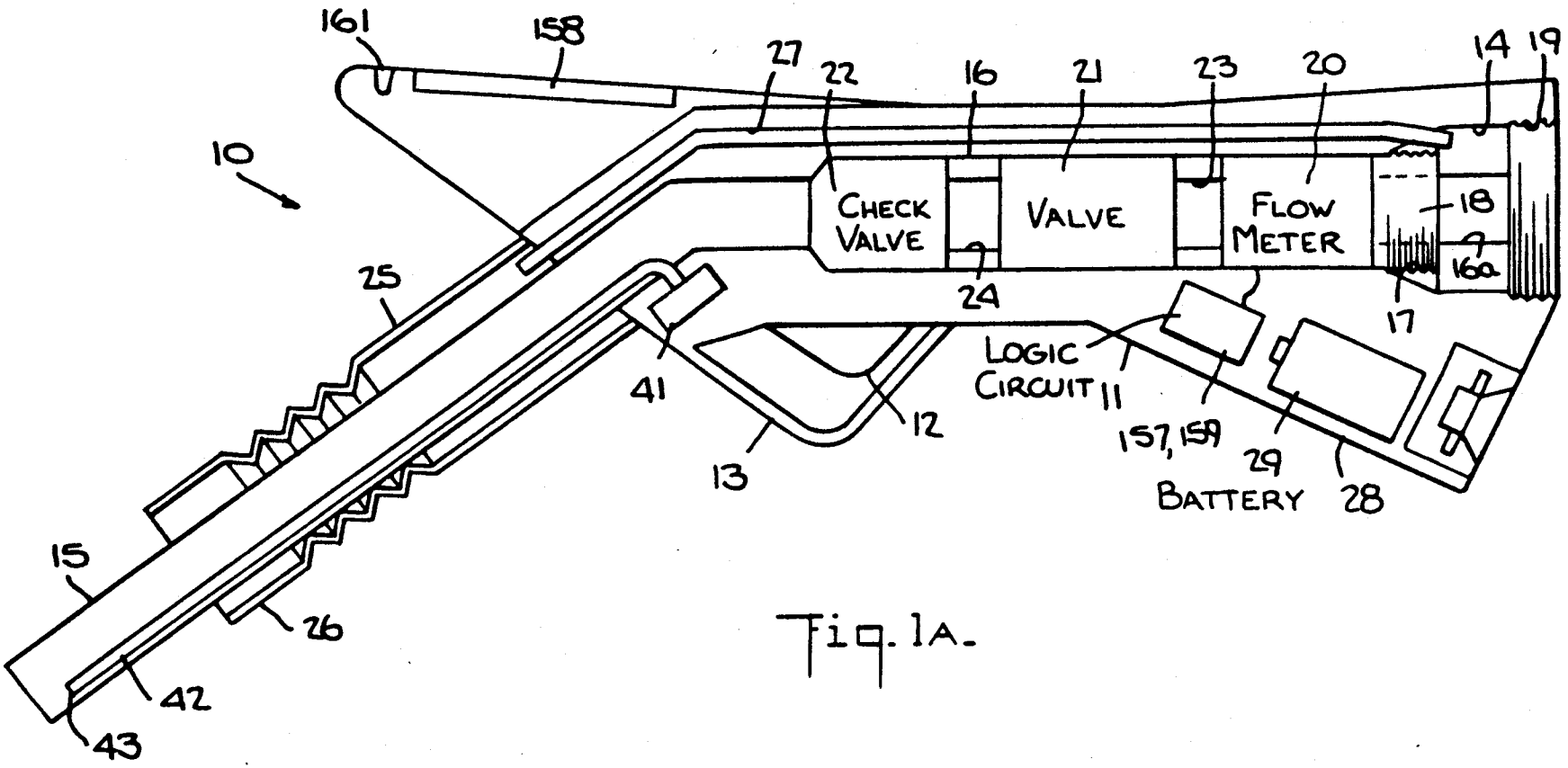
FIG. 1*a* is a side, cross-sectional view of the nozzle illustrated in FIG. 1

Referring now to the drawings, and initially to FIGS. 1 and 1*a*, a fluid dispensing nozzle according to the present invention is generally indicated by the reference numeral 10. The nozzle includes a handle 11 that can be prefabricated from a rigid plastic material, such as, e.g. Lexan brand plastics manufactured by General Electric Plastics, or other suitable materials, such as cast aluminum. The handle 11 is generally arranged and configured for convenient handling by a user and such that a user's index finger is positioned over a flow control trigger 12 upon lifting of the handle 11. The trigger 12 is rotatably mounted on a lower surface of the handle 11 for rotation by the user to control the flow of a fluid through the nozzle, as will appear. The handle 11 is provided with an integral guard rail 13 that extends around the trigger 12, as illustrated.

An internal channel 14 is formed within the handle 11 and extends axially through the entire length of the handle 11. As illustrated in FIGS. 1 and 1*a*, the front portion of the handle 11 is in an angular relation to the rear portion thereof to facilitate the insertion of the nozzle 10 into an intake pipe of a motor vehicle fuel tank (not illustrated). To that end, a generally cylindrical, angled spout 15 is received within and securely mounted by the internal channel 14 at the downstream end of the handle 11 to direct fluid flow within the intake pipe. The internal channel 14 is flared to an expanded internal diameter at the upstream most end of the mounted spout 15 to receive a modular housing 16 that is inserted through the upstream most end of the internal channel 14 and placed into a fluid coupling with the upstream most end of the spout 15.

A threaded internal surface 17 of the internal channel 14 threadily engages an outer threaded surface 18 formed at the upstream end of the modular housing 16 to secure the modular housing 16 within the internal channel 14 and in the fluid communication relation to the spout 15. Alternatively, the modular housing 16 can be secured within the internal channel 14 by utilizing O-rings surrounding the housing and press fit into receiving grooves formed in the internal channel 14. A further threaded internal surface 19, at the upstream most end of the internal channel 14, is utilized to secure the nozzle 10 to a hose (not illustrated) such that fluid under pressure can flow from a storage tank (not illustrated) and into the internal channel 14 of the handle 11, as described above.

Pursuant to a feature of the invention, the modular housing 16 is arranged to mount, in series, an in-line fluid flow meter 20, e.g. a turbine flow meter including a magnetic pick-up to generate an electrical output signal representative of fluid flow through the nozzle 10, an in-line flow control main valve 21 and a check valve 22. An electronic meter logic and control device 157 is mounted within the handle 11 and coupled to an output of the flow meter 20. The meter logic and control device 157 is also coupled to a communication logic and interface device 159, also mounted within the handle, as will appear.

To that end, in one embodiment of the invention, the handle 11 includes a battery housing 28 integrally formed therein to mount a battery 29, which can comprise a rechargeable battery. The battery 29 provides a source of electrical power to the electronic meter logic and control device 157 and communication logic and interface device 159.

A forward top portion of the handle 11 is formed to a housing to mount a display device 158, such as an LCD display, a key pad 162, for interactive use by a user and a magnetic card reader 161 for insertion of e.g. a credit card. The forward top portion is arranged to be aligned with the nozzle spout 15 relative to a user's line-of-sight when he or she lifts the handle 11 for use of the nozzle 10.

The threaded surface 18 of the modular housing 16 surrounds a fluid inlet 16*a* of the modular housing 16 that is placed in fluid communication with the hose (not illustrated) by virtue of the structural relationship between the threaded surfaces 17, 19 of the internal channel 14 (see FIG. 1). In this manner, fluid flow from the hose enters the interior of the modular housing 16 via the inlet 16*a* and flows into the in-line turbine flow meter 20.

A pair of fluid channels 23, 24 formed within the modular housing 16 provides fluid communication between the in-line flow meter 20 and in-line flow control valve 21 and between the in-line flow control valve 21 and the check valve 22, respectively. The downstream most end of the check valve 22 is positioned at the fluid communication interface between the modular housing 16 and spout 15 so that pressurized fluid flow from the hose (not illustrated) flows through the inlet 16*a*, in-line flow meter 20, fluid channel 23, in-line flow control valve 21, fluid channel 24, check valve 22 and spout 15 to controllably dispense a pressurized fluid from a storage tank and into a fuel tank of a motor vehicle via the nozzle 10.

Substantially all of the moving mechanical parts of the nozzle 10 are arranged within the modular housing 16, which is readily inserted into the internal channel 14 of the prefabricated handle 11 during assembly of the nozzle 10 and also readily removable from the handle 11 for repair and/or replacement, if necessary.

A flexible, generally cylindrical vapor recovery seal 25 is affixed to the front end of the handle 11 and extends in a co-axial relation to the spout 15. The seal 25 includes a generally cylindrical end portion 26 having an open downstream most end that circumscribes the spout 15. The seal 25, including the end portion 26, is dimensioned so that the open end of the end portion 26 fits over the open end of the intake pipe (not illustrated) of a motor vehicle when the spout 15 is inserted into the intake pipe to dispense fluid to the motor vehicle fuel tank. In this manner, fluid vapors that may develop during operation of the nozzle 10 are captured by the vapor recovery seal 25. The vapor recovery seal 25 communicates with a vapor recovery channel 27 formed within the handle 11 and arranged to extend from the vapor recovery seal 25 to an area within the internal channel 14 and adjacent the thread surface 19. Accordingly, vapors captured by the vapor recovery seal 25 will flow back to the upstream end of the modular housing 16 for continued flow to a vapor recovery system incorporated into the hose (not illustrated).

A transducer pressure sensor 41 is mounted within the handle 11 and includes a tube 42 arranged to extend within the spout 15 to a position near the downstream end of the spout 15. A column of air is ordinarily within the tube 42 such that a rise of fluid level to within the spout 15 and above the lower most end 43 of the tube 42 causes an increase of the air pressure within the tube 42. The increased air pressure is sufficient to actuate the transducer for overflow protection, as will be described in greater detail below.

Figure 2:
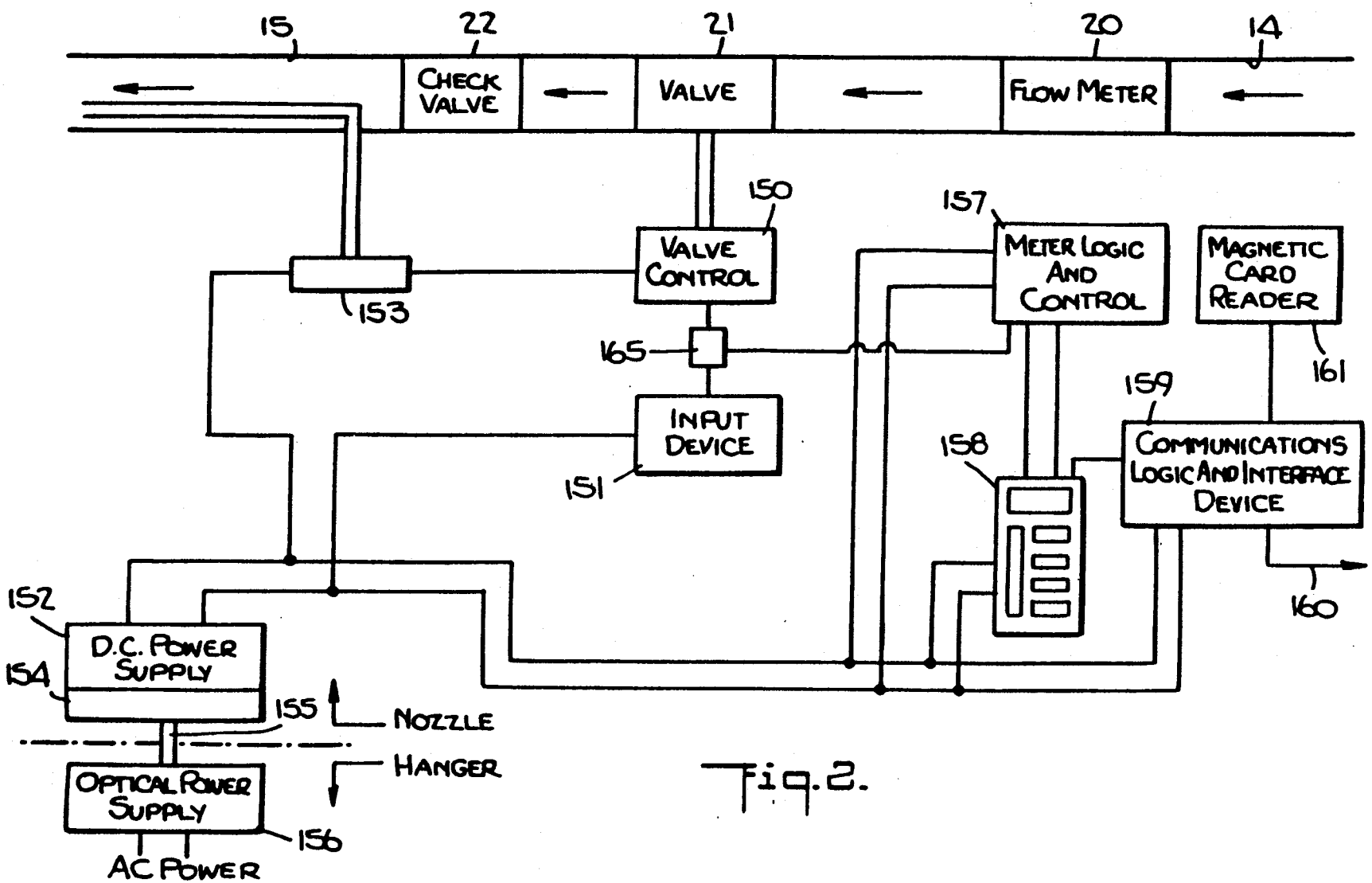
FIG. 2 is a block diagram of an electrical system of a nozzle system according to the present invention.

FIG. 2 illustrates a block diagram of an electrical system according to the present invention. As described above with respect to FIG. 1*a*, fluid flow is through an internal channel 14 of the nozzle 10 and flows through an in-line flow meter 20, in-line control valve 21 and check valve 22 into the spout 15. The valve is coupled to an electrical control 150 that can be coupled to an input signal device 151, actuated by the trigger 12 as will be described below.

To complete the electrical circuit, the input signal device 151 is coupled to a D.C. power supply 152 which is, in turn, electrically coupled to a fluid actuated switch device 153 for overflow protection, as for example, the pressure sensitive switch 41 (See FIG. 1*a*).

The D.C. power supply 152 is electrically coupled to an optical power converter 154 that receives an optical signal from an optical cable 155 for conversion to electric power. The optical cable 155 is coupled to a remote source comprising an A.C. powered optical power supply 156 which may be used to provide optical power to other nozzles 10.

Pursuant to another feature of the invention, the D.C. power supply 152 is also electrically coupled to the meter logic and control device 157, the display device 158 and the communications logic and interface device 159, as a source of power. The meter logic and control device 157 is coupled to the in-line flow meter 20 and can comprise a general purpose microprocessor that is programmed to read the output of the in-line flow meter 20, to determine preselected data relating to the fluid flow during each use of the nozzle 10 and to process purchase and sale transaction information relating to the dispensing of the fluid. The display device 158 can comprise an LCD display and is coupled to the meter logic and control device 157 to display the data generated by the device 157.

The communications logic and interface device 159 can also comprise a general purpose microprocessor that is programmed to transmit data generated by the device 157 through a communication link 160 to a remote data processing system (not illustrated). For that purpose, the communication logic and interface device 159 is coupled to the display device 158 for input of the data. The communication logic and interface device 159 can also be coupled to the magnetic card reading mechanism 161 so that customer credit card account information can be read directly at the nozzle 10 for processing with the fluid flow data of each use of the nozzle 10.

Figure 2A:
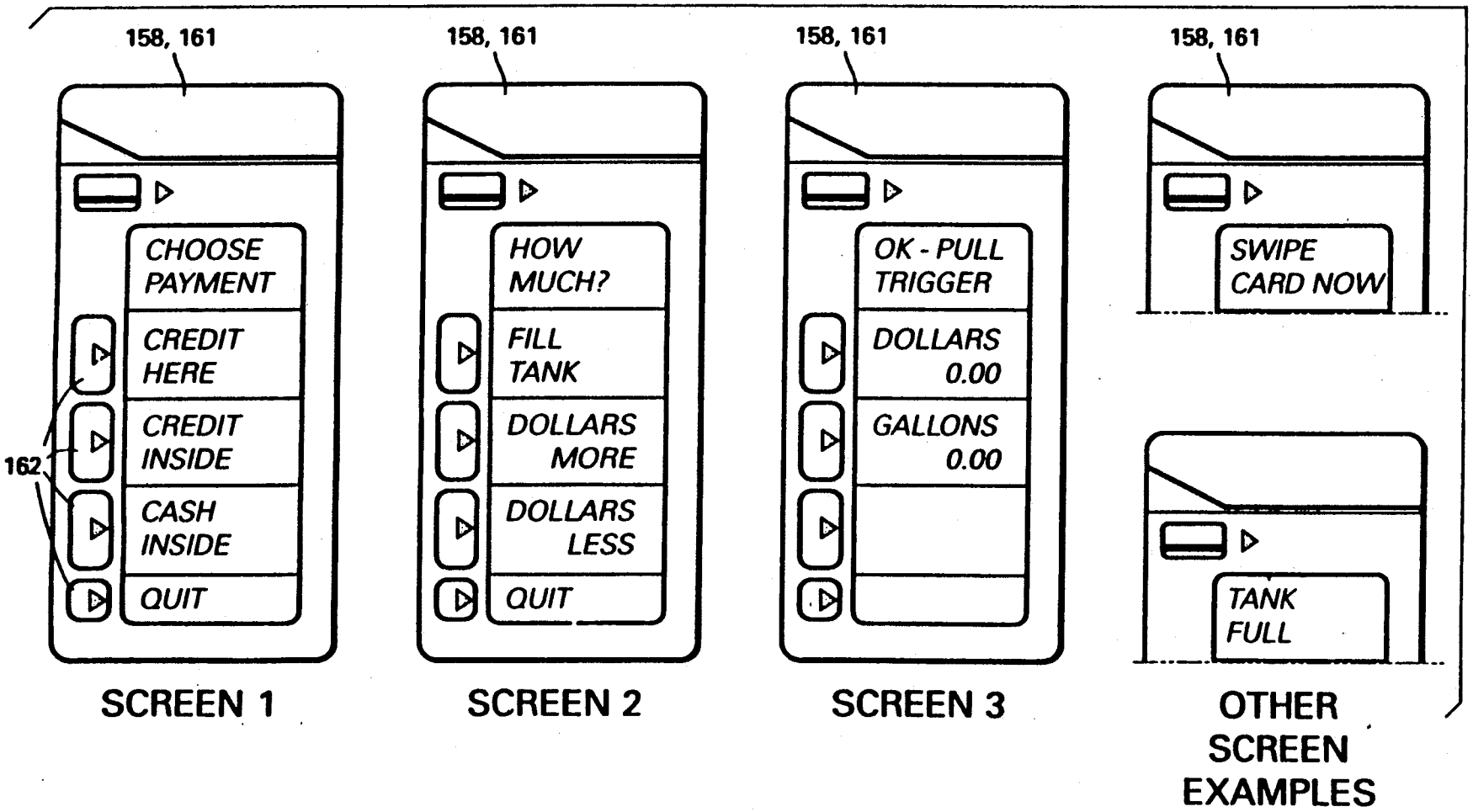
FIG. 2*a* depicts examples of display logic of the display device of the nozzle system of FIG. 2.

FIG. 2*a* illustrates several examples of information that can be displayed on the display device 159 by the meter logic and control device 157. The display device 159 depicted in FIG. 2*a* includes the key pad 162 for input of information by a user. As described above, the magnetic card reading mechanism 161 is integrated into the common housing with the display device 159 to facilitate the completion of all tasks relating to the dispensing of fuel directly at the point of delivery.

As shown in FIG. 2*a*, the information can include prompters to the user regarding the method of payment, the amount of gasoline to be purchased in either dollar amount or gallons of fuel, with the appropriate key of the key pad 162 adjacent to the particular display being used for interactive processing by the user. The display can also indicate when it is appropriate to pull the trigger, as e.g. when a mercury switch 100 is properly oriented, as will be described below and when the tank is filled, as e.g. when the fluid actuated switch 153 senses a fluid level within the spout 15. The meter logic and control device 157 can also be used to activate a switch 165 when a preselected amount of fuel has been dispensed to interrupt power from the D.C. power supply 152 and thereby close the valve 21.

The in-line flow meter 20 and meter logic and control device 157 coupled thereto, as well as the display device 159, key pad 162 and magnetic card reader 161 mounted on the handle 11 significantly increase the overall functionality of the nozzle 10. The effectiveness of the nozzle 10 is enhanced by positioning the key pad 162, display device 159 and magnetic card reader 161 in the user's line-of-sight. The meter logic and control device 157 provides a programmable data processing capability to monitor fluid flow information provided by the electronic in-line flow meter 20 and to operate, e.g. the switch 165 to control the electrical valve control 150 such that the nozzle 10 operates to dispense fluid as a function of the series of display-driven user prompter controls facilitated by the display device 159 and key pad 162.

Pursuant to a feature of the invention, the in-line flow control valve 21 includes an electrical actuation that is utilized in the control of the opening and closing of the control valve 21 and an automatic mechanical valve shut-down device that operates to automatically close the flow control valve 21 upon any interruption of electrical power to the valve 21.

Figure 3A:
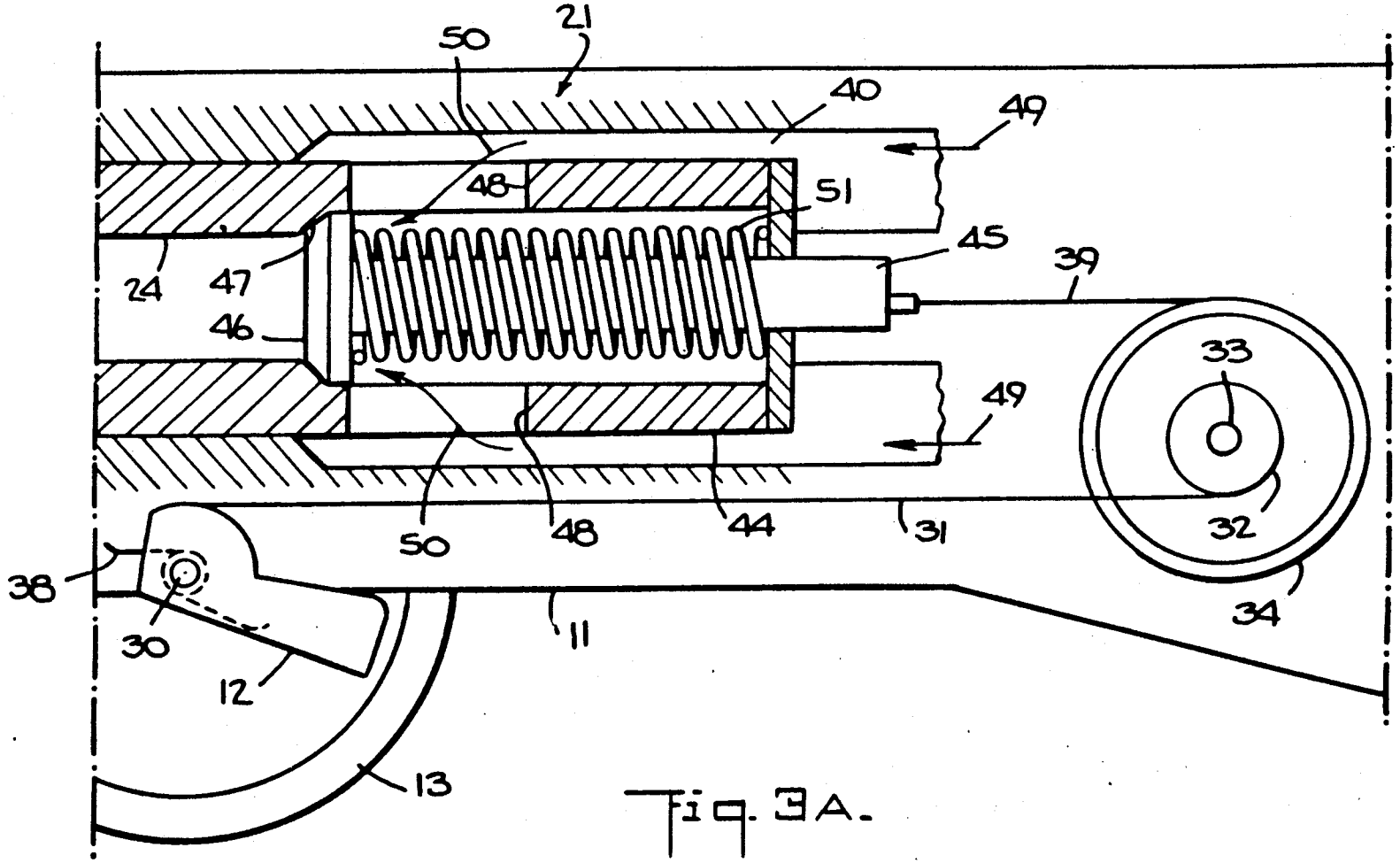
FIG. 3*a* is a side view of one embodiment of a valve and valve actuator for use in a nozzle according to the present invention with the valve illustrated in the closed position.
Figure 3B:
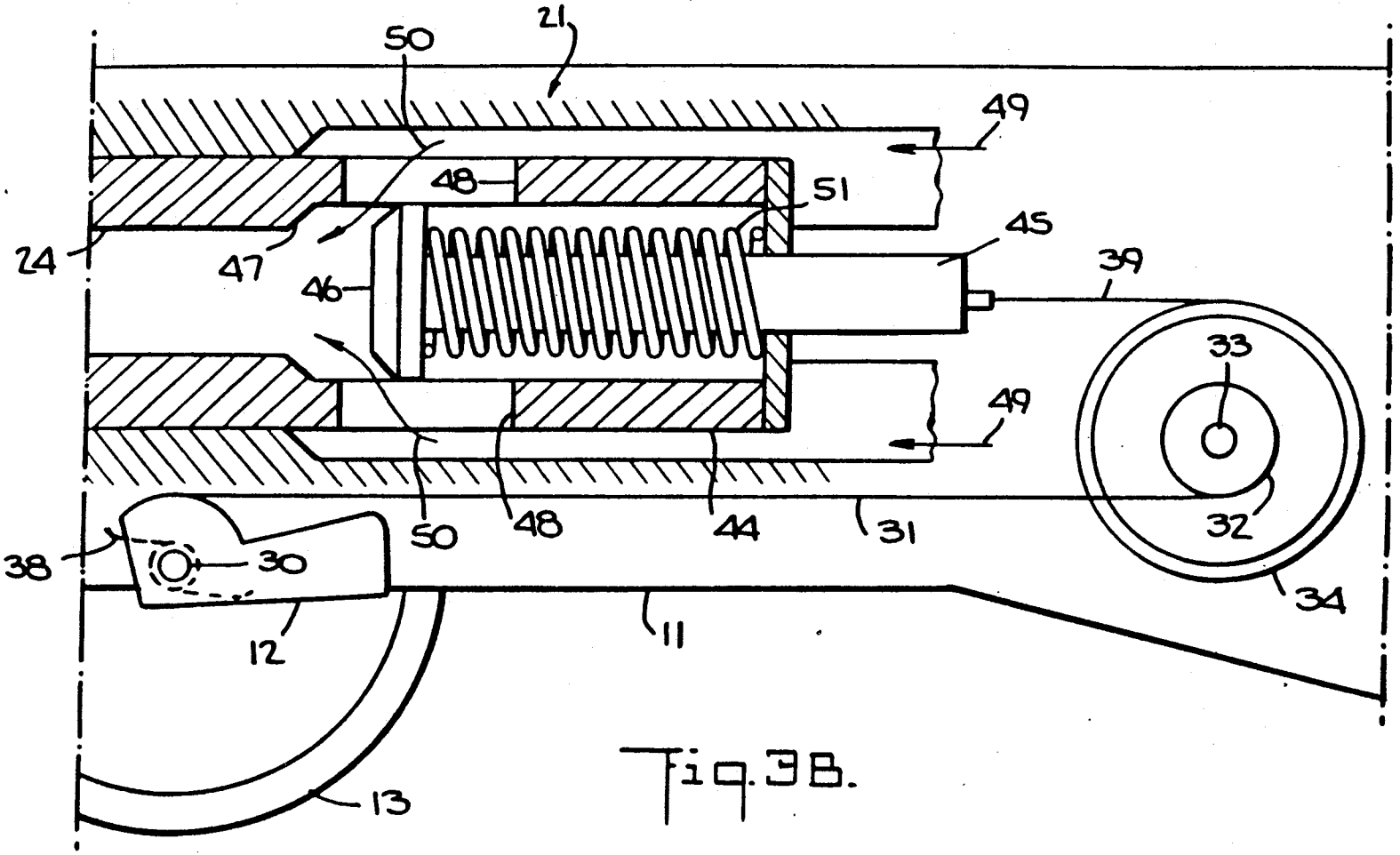
FIG. 3*b* is a side view of the valve and valve actuator of FIG. 3*a* illustrating the valve in an open position.
Figures 4, 5:
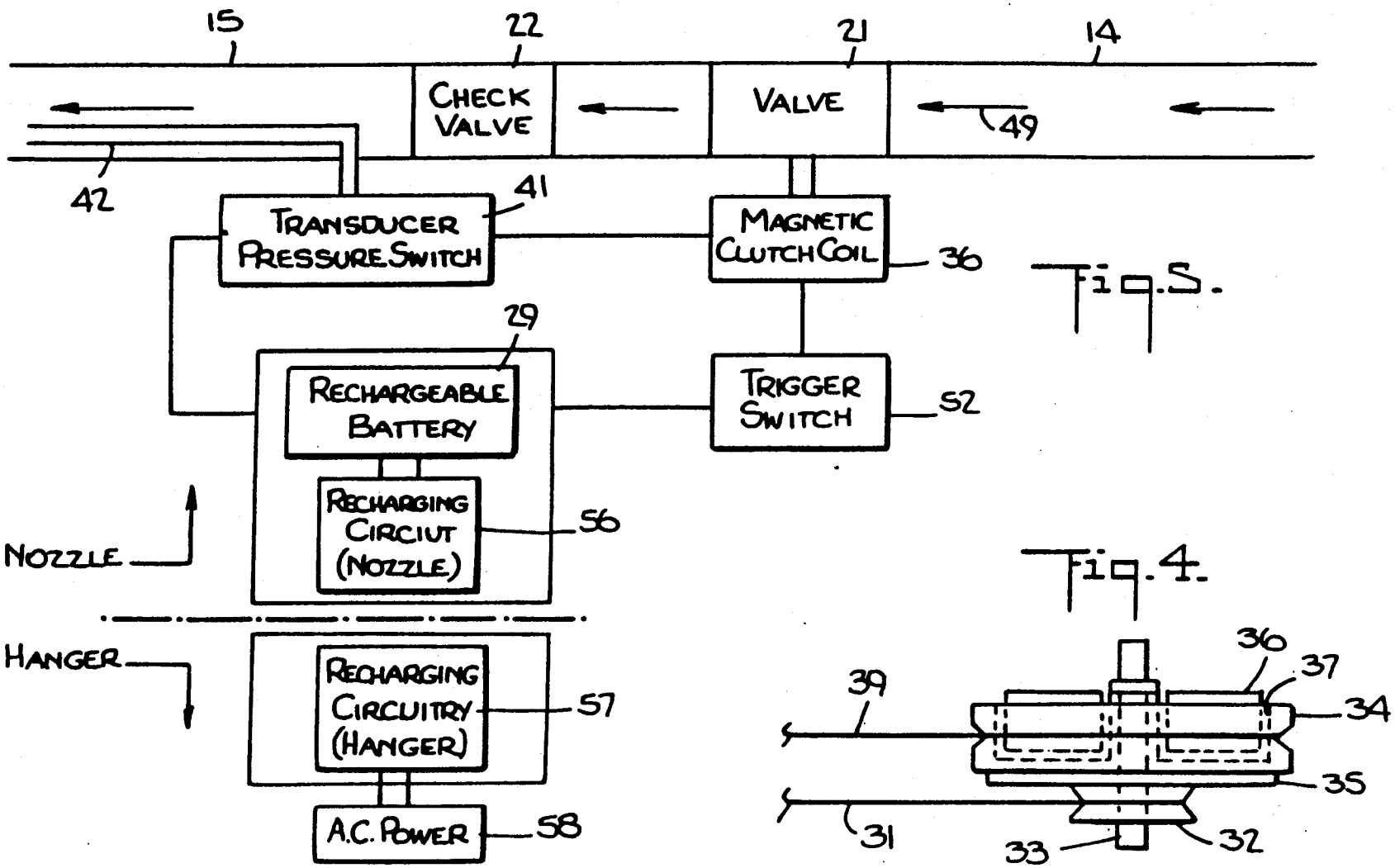
FIG. 4 is a top view of a magnetic clutch and pulley system of the actuator of FIGS. 3 and 3*a*.
FIG. 5 is a block diagram of an electrical system for a nozzle according to FIGS. 3*a, b* and 4.

Referring now to FIGS. 3*a*, 3*b* and 4, according to one embodiment of the invention, the trigger 12 is rotatably mounted within the handle 11 by a pivot pin 30 and is connected to one end of a trigger cable 31 arranged to extend within the handle 11 to a trigger pulley 32. The other end of the trigger cable 31 is connected to and wound around the trigger pulley 32 a number of turns sufficient to unwind from and rotate the trigger pulley 32 when a user axially displaces the trigger cable 31 away from the trigger pulley 32 by rotating the trigger 12 about the pivot pin 30. A biasing spring 38 is arranged to act between the handle 11 and the trigger 12 so as to urge the trigger 12 in a clockwise direction relative to the pivot pin 30, to thereby urge the trigger toward the closed valve position, as illustrated in FIG. 3*a*. The trigger pulley 32 is rotatably mounted on an axle 33 supported within the in-line flow control valve 21.

A valve pulley 34 is also rotatably mounted on the axle 33 and is mechanically coupled to the trigger pulley 32 by an electrically actuated magnetic clutch 35. The magnetic clutch 35 is controllably actuated by a magnetic clutch coil 36, as will appear, that is mounted on the axle 33 and received within a recess 37 formed on the side of the valve pulley 34 opposite from the side thereof coupled to the trigger pulley 32, as most clearly illustrated in FIG. 4. A valve cable 39 is connected at one end to the valve pulley 34. Each of the trigger pulley 32 and valve pulley 34 can include a coil spring (not specifically illustrated) acting between the axle 33 and the respective pulley 32, 34 to urge each pulley in a counter clockwise rotational direction.

The in-line flow control valve 21 comprises a valve housing 40 arranged to support a valve cage 44 that extends within the valve housing 40 in a co-axial relation to the longitudinal axis of the housing 40. A valve stem 45 is arranged for axial movement within the valve cage 44 and includes a valve plug 46 securely mounted at the downstream most end of the valve stem 45. The valve cage 44 forms a valve seat 47 that is configured to mate with the valve plug 46 when the valve 21 is closed, as illustrated in FIG. 3*a*.

Fluid flow from the flow channel 23 flows around the valve cage 44 and into the interior thereof through fluid inlets 48, as indicated by the flow direction arrows 49, 50. When the valve plug 46 is seated against the valve seat 47, fluid flow through the flow control valve 21 is prevented.

A coil spring 51 is mounted within the valve cage 44, in a co-axial relation to the valve stem 45, and acts between the valve cage 44 and the valve plug 46 to urge the valve stem 45 into the closed valve position illustrated in FIG. 3*a*.

The other end of the valve cable 39 is affixed to the upstream end of the valve stem 45. Rotation of the trigger 12 by a user will tension and axially displace the trigger cable 31 in a direction causing the trigger pulley 32 to rotate in a clockwise rotational direction. When the magnetic clutch coil 36 is energized, the magnetic clutch 35 provides a mechanical linkage between the rotating trigger pulley 32 and the valve pulley 34 thereby rotating the valve pulley 34, also in a clockwise rotational direction.

This results in the valve cable 39 being wound onto the valve pulley 34 to thereby apply an axial force to the valve stem 45, in the upstream direction, against the coil spring 51 and away from the valve seat 47. Accordingly, the valve plug 46 is controllably lifted from the mating relation with the valve seat 47, as illustrated in FIG. 3*b*, to permit fluid flow through the valve seat 47 and into the flow channel 24. The fluid inlets 48 are dimensioned so that pressurized fluid can flow to both the upstream and downstream sides of the valve plug 46 to balance the valve plug 46 for ease of operation.

Referring now to FIG. 5, there is illustrated, in block diagram form, the electrical system of the nozzle 10 as it relates to the above-described magnetic clutch embodiment of the invention illustrated in FIGS. 3*a*, 3*b* and 4. A rechargeable battery 29 is electrically coupled to a trigger actuated switch 52, which is, in turn, electrically coupled to the magnetic clutch coil 36. The electric circuit is completed by an electrical coupling between the magnetic clutch coil 36 and the transducer pressure switch 41 and a further electrical coupling between the transducer pressure switch 41 and the battery 29. The trigger switch 52 is arranged adjacent to the trigger 12 (not specifically illustrated) such that, upon rotation of the trigger 12 by a user, the trigger 12 contacts and closes the trigger switch 52. The trigger switch 12 remains closed as long as the trigger 12 is displaced from the valve closed position illustrated in FIG. 3*a*. The transducer pressure switch 41 is normally closed. Thus, upon the closing of the trigger switch 52, the magnetic clutch coil is energized, and the above-described cable displacement due to the rotation of the trigger 12 causes the valve to open.

Figure 6:
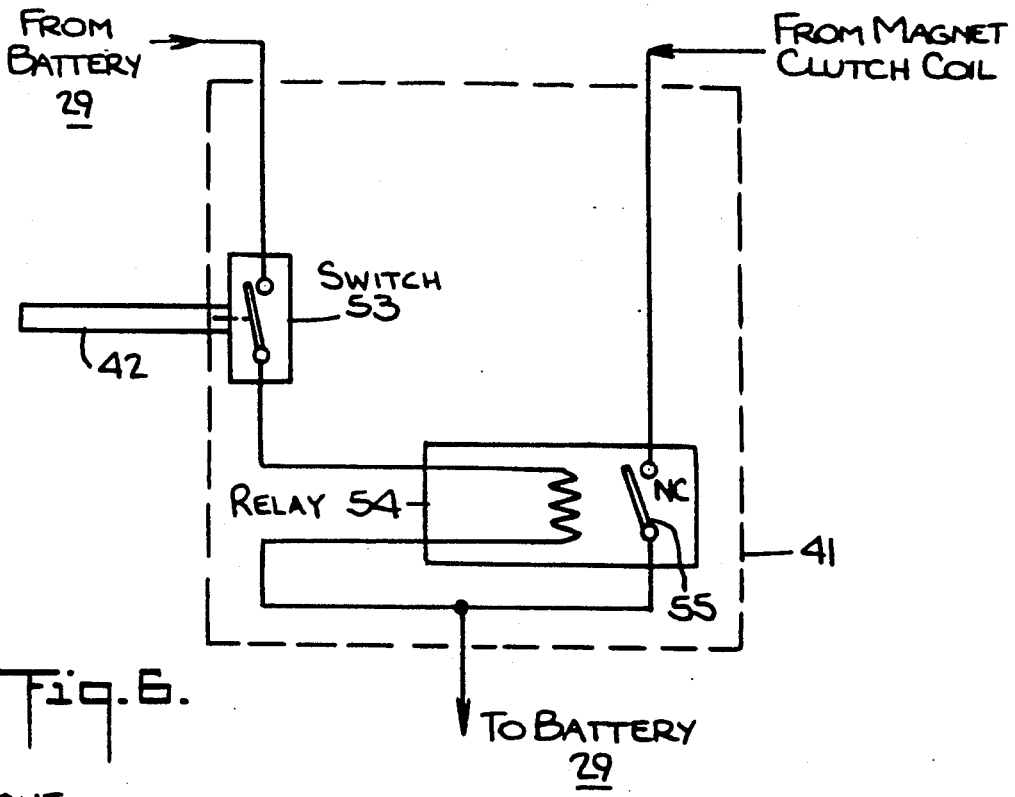
FIG. 6 is a schematic of a transducer pressure switch of the electrical system of FIG. 2.

Referring to FIG. 6, the transducer pressure switch 41 includes, e.g. a normally open low-pressure switch 53 manufactured by World Magnetics. The low pressure switch 53 is electrically coupled in series with the battery 29 and an electro mechanical relay 54 that is coupled to a normally closed switch 55. The switch 55 is electrically coupled in series with the battery 29 and magnetic clutch coil 36 and in parallel to the low pressure switch 53 and relay 54. As described above, the rise of the fluid level to above the end 43 of the tube 42 causes an air pressure increase within the tube 42 to close the low pressure switch 53 to thereby energize the relay 54. The relay 54 will then operate to mechanically open the switch 55 to interrupt electrical power to the magnetic clutch coil 36.

Upon an interruption of electric power to the magnetic clutch coil 36, the valve pulley 34 will slip relative to the trigger pulley 32 and the coil spring 51 will cause the valve stem 45 to move toward and into the closed valve position illustrated in FIG. 3*a*. The automatic valve shut down provided by the operation of the transducer pressure sensor 41 and the coil spring 51 does not depend upon a fluid flow within the nozzle and any manipulation of the trigger 12 by a user after valve shut-down will not restart fluid flow.

In accordance with another feature of the invention, the battery 29 comprises a rechargeable battery and includes a recharge circuit 56 that is removably coupled to a recharge circuit power supply 57. The recharge circuit power supply 57 can be mounted in a cradle or other support (not specifically illustrated) used to house the nozzle 10 when the nozzle 10 is not in use. Accordingly, the battery 29 can be continuously recharged between each use of the nozzle 10. Of course, the battery 29 is coupled to the electronic components described above and as illustrated in FIG. 2.

The recharge circuit 57 is coupled to an AC power supply 58 that can be remote from the recharge circuit 57 and used to power other similar recharge circuits used throughout a service station. Referring now to FIG. 5*a*, there is illustrated a recharge circuit 56 according to the present invention. The recharge circuit 56 comprises a transformer secondary coil 200 wrapped around a first magnetic core 201. Two leads 202, 203 of the transformer secondary coil 200 are coupled as inputs to a full wave diode rectifier 204. Leads 205, 206 provide a D.C. output of the diode rectifier 204, for coupling to the rechargeable battery 29, as indicated in FIG. 5*a*.

The recharge circuit power supply 57 comprises a transformer primary coil 207 wrapped around a second magnetic core 208 and mounted within a support for the nozzle 10, as described above. Pursuant to a feature of the invention, the second magnetic core 208 is arranged within the support at a position closely proximate the position of the first magnetic core 201, when the nozzle 10 is mounted by the support, to complete a magnetic coupling between the first and second magnetic cores 201, 208. In this manner, current flow in the primary coil 207 will induce current in the secondary coil 200 to power the rectifier 204 and thereby recharge the battery 29. Thus, the power coupling between the recharge circuit power supply 57 and recharge circuit 56 is achieved solely by a magnetic coupling and without the need for any removable electrical couplings.

A pair of leads 209, 210 electrically couple the primary coil 207 to the source of AC power 58. A switch 211 can be coupled in series with the primary coil 207 for on/off control of the power supply 57.

A further embodiment of the present invention is illustrated in FIG. 5*b*. An optical to electrical converter 250, including a rectifier, is used to replace the battery 29 and is coupled between the trigger switch 52 and pressure transducer 41. The converter 250 is coupled by an optical cable 251 to an optical power output of an electrical to optical power converter 252, mounted within the support for the nozzle 10. The converter 252 is, in turn, electrically coupled to the source of AC power 58. A switch 253 can be coupled in series with the converter 252, for on/off control of the converter 252. The system according to FIG. 5*b* comprises a representative embodiment of the D.C. power supply 152, optical power supply 156 arrangement of the block diagram of FIG. 2.

Figure 7:
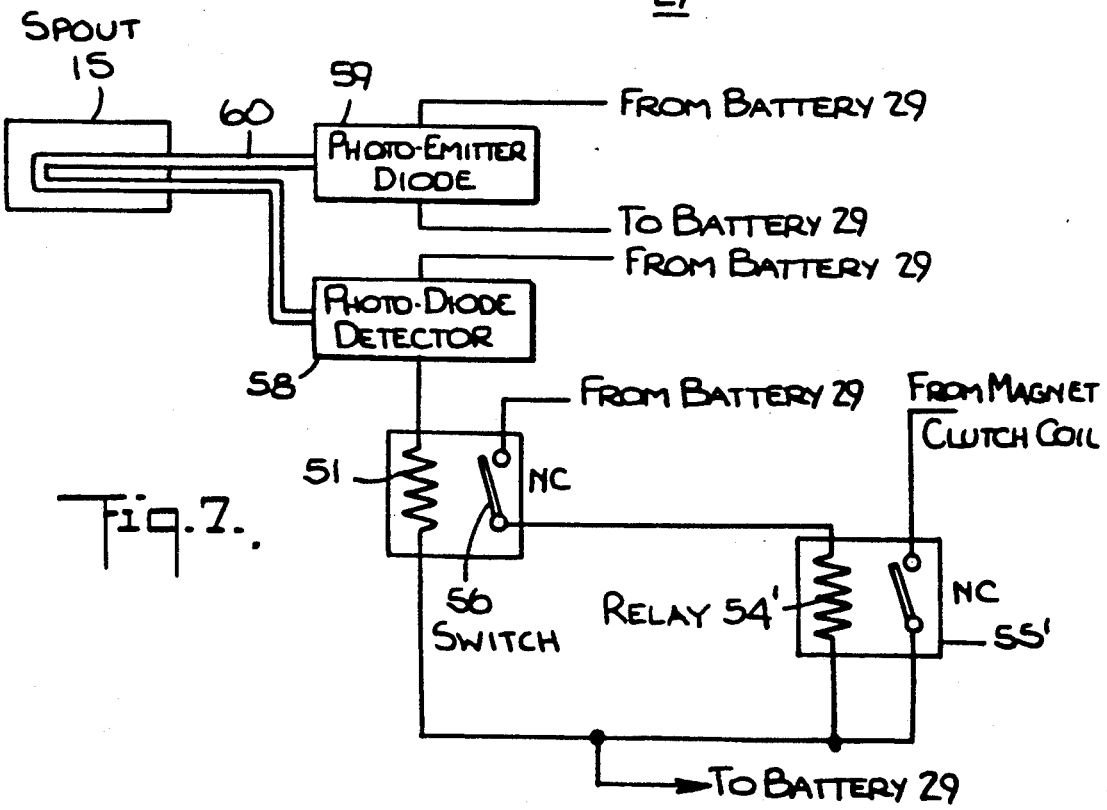
FIG. 7 is a schematic of an optical sensor driven switching mechanism according to the present invention.

Pursuant to another embodiment of the present invention, power interruption to the electrical in-flow control valve 21 is caused by detection of a rise of fluid level within the spout 15 by an optical sensor driven switching mechanism. Referring to FIG. 7, there is illustrated a schematic for an optical sensor driven switch 41' used in place of the transducer pressure switch 41. Similar to the transducer pressure switch embodiment, a normally closed switch 55' is electrically coupled in series with the magnetic clutch coil 36 and the battery 29. The switch 55' is coupled to a relay 54' that operates to open the switch 55' upon optical detection of a rise in the fluid level to within the spout 15, as will appear.

As illustrated in FIG. 7, the relay 54' is electrically coupled in series with the battery 29 and a normally closed switch 56. As long as the normally closed switch 56 is held in the open position, the relay 54' is not energized and power is supplied to the magnetic clutch coil 36. To that end, the normally closed switch 56 is coupled to a relay 57 that ordinarily holds the switch 56 in the open position. The relay 57 is electrically coupled in series to the battery 29 and a photo-diode detector 58 that is in a conducting state when a source of light is applied to the photo-diode detector 58.

A source of light comprises a photo-emitter diode 59, electrically coupled in series to the battery 29 and optically coupled to an optical probe 60 arranged to extend within the spout 15 to a position near the downstream most end of the spout 15, similar to the air tube 42.

Referring to FIG. 8*a*, the optical probe 60 comprises a total internal reflection probe having an index of refraction substantially equal to the index of refraction of the fluid being dispensed by the nozzle and including a continuous loop of optical fiber extending from the photo-emitter diode 59 down through the spout 15 and back to the photo-diode detector 58. The downstream most end 61 of the optical fiber loop is arranged and configured to have radii of curvature at each loop bend 62 suitable to provide internal reflection within the fiber 60 of the light 63 provided by the photo-emitter diode 59 for transmission to and reception by the photo diode detector 58. As described above, as long as the photo-diode detector 58 receives light, it will conduct, causing power to be supplied to the relay 57 which then operates to hold the switch 56 in an open position.

Referring to FIG. 8*b*, when the fluid level 64 rises within the spout 15 and above the bends 62 of the optical probe 60, a significant portion of the light is not reflected at the fiber surface, but continues into the fluid, due to the near equal indexes of refraction of both the optical fiber and the fluid. Accordingly, the amount of light reaching the photo-diode detector 58 is greatly diminished causing an interruption of power to the relay 57. This results in the switch 56 switching to its normally closed position to thereby energize the relay 54', that then operates to mechanically open the switch 55' to interrupt power to the magnetic clutch coil 36.

As illustrated in FIG. 8*c*, the optical fiber probe 60 that extends within the spout 15 is covered by an opaque shield screen 65 to prevent normal fluid flow through the spout 15 from affecting light reflection and transmission within the probe 60. The downstream most end of the probe 60, including the loop bends 62, is received within a housing 66 that is mounted to an internal wall of the spout 15 and is arranged to surround the downstream most end of the probe 60. The housing 66 also prevents normal fluid flow through the spout 15 from affecting light reflection at the loop bends 62. The housing 66 defines an open end 67 that faces the downstream direction of fluid flow within the spout 15 and is positioned adjacent the downstream most end of the spout 15. Moreover, an air/vapor aperture 68 is formed through the spout 15 to provide fluid communication between the interior of the housing 66 and the atmosphere.

Accordingly, light transmitted from the photo-emitter diode 59 through the probe 60 will be reflected at the loop bends 62 and transmitted to the photo-diode detector 58 so long as the level 64 of fluid is below the bends 62 of the probe 60, irrespective of fluid flow within the spout 15. When the fluid level 64 rises to within the spout 15, fluid will enter the housing 66 through the opening 67 and rise with the rise of the fluid level within the spout 15 to the loop bends 62 to interrupt internal reflection within the probe 60 and cause power interruption to the in-line flow control valve 21, as described above. Any air or vapor within the housing 66 prior to the rise of the fluid level to within the housing 66 will escape from the interior of the housing 66, under pressure caused by the rising fluid, through the air/vapor aperture 68.

Figure 9:
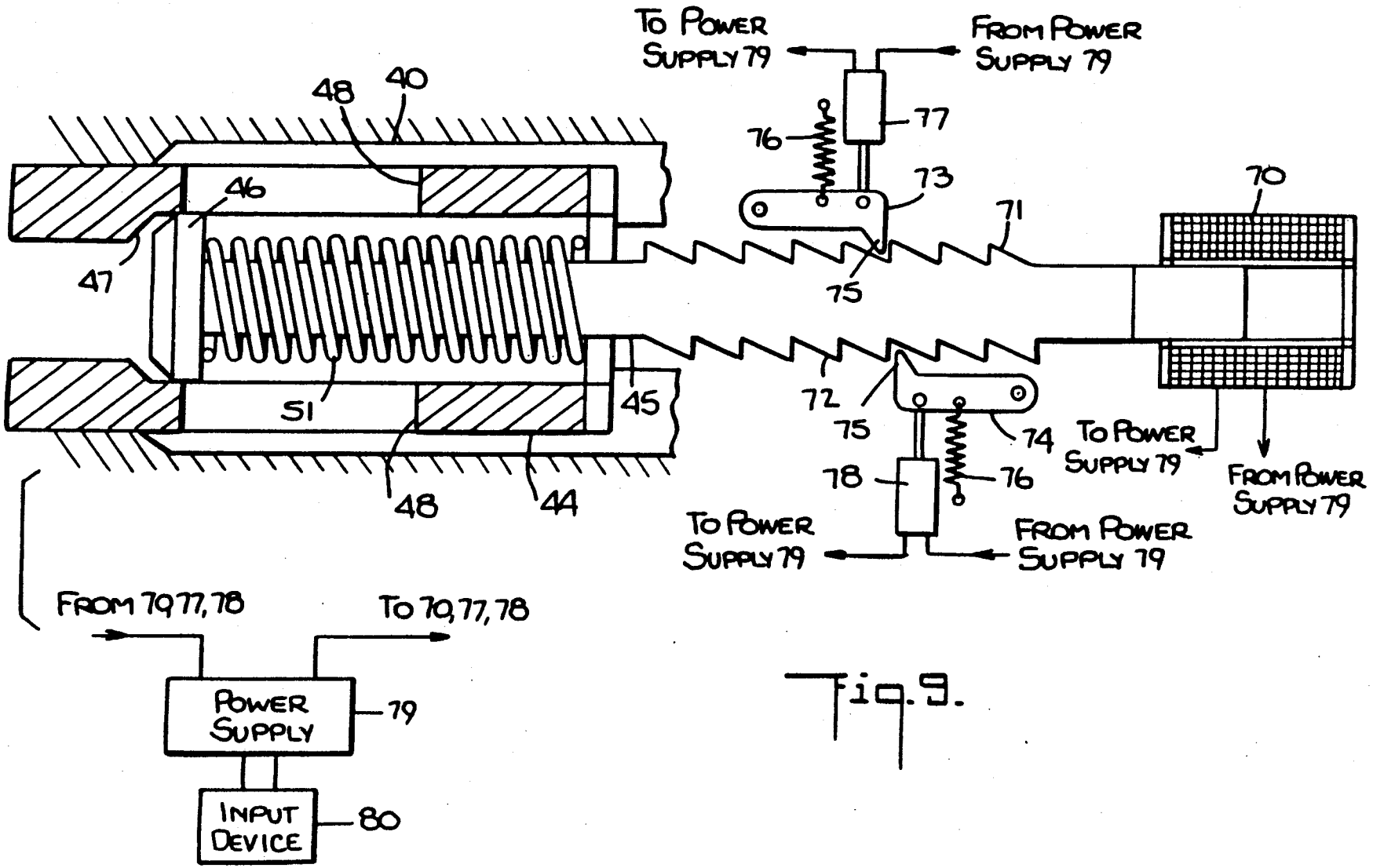
FIG. 9 is a side view of another embodiment of a valve and valve actuator for use in a nozzle according to the present invention.

Referring now to FIG. 9, there is illustrated another embodiment of a valve actuator for use in the nozzle 10 according to the present invention. The valve itself is similar in construction to the valve of the embodiment illustrated in FIGS. 3*a* & *b* and like reference numerals are used to designate the valve housing 40, valve cage 44, valve stem 45, valve plug 46, valve seat 47, fluid flow inlets 48 and spring 51. However, in FIG. 9, the valve stem 45 is in a direct mechanical coupling to an electric drive motor device 70 that controllably operates to move the valve stem 45 linearly in valve opening and valve closing directions. The motor device 70 can comprise a rotary motor having a known rotary-to-linear mechanical coupling to the valve stem 45 or a linear electric motor, such as a solenoid, directly mechanically coupled to the valve stem 45. In the illustrated embodiment, the motor 70 comprises a pull solenoid.

The valve stem 45 is also formed to include a pair of saw-tooth surfaces 71, 72, which are pitched opposite to one another, as illustrated in FIG. 9. A lever 73, 74 is rotatably mounted adjacent each surface 71, 72, each lever 73, 74 including a surface engaging tip 75 that is controllably moved into engagement with a respective surface 71, 72 by rotation of the corresponding lever 73, 74. The saw-tooth surface 71 is pitched such that, when the tip 75 of the lever 73 is in engagement with the surface 71, the valve stem 45 can be moved in a valve opening direction, but is prevented from moving in a valve closing direction by the engagement between the saw-tooth surface 71 and the tip 75 of the lever 73.

Similarly, the saw-tooth surface 72 is pitched such that, when the tip 75 of the lever 74 is in engagement with the surface 72, the valve stem 45 can be moved in a valve closing direction, but is prevented from moving in a valve opening direction by the engagement between the saw-tooth surface 72 and the tip 75 of the lever 74.

Each of the levers 73, 74 is connected to a coil spring 76 that urges the respective levers 73, 74 away from engagement with the corresponding saw-tooth surfaces 71, 72. Moreover, each lever 73, 74 is mechanically coupled to a push solenoid 77, 78 that operates, when energized, to push the respective lever 73, 74 against the action of the spring 76 and into engagement with the corresponding saw-tooth surface 71, 72. Of course, the springs 76 operate to disengage the levers 71, 72 from the saw-tooth surfaces 71, 72 whenever the respective solenoids 77, 78 are deactivated.

Pursuant to a feature of the valve actuator of FIG. 9, each of the solenoids 77, 78 and the electric drive motor device 70 are coupled to a power supply 79 that operates to selectively energize those devices in accordance with an input binary control signal. The power supply 79 can comprise the electrical control 150 of FIG. 2.

For example, a two bit binary signal can represent four different binary input control signals: 00, 01, 10 and 11. Each of the control signals causes the power supply 79 to energize the solenoids 77, 78 and the electric drive motor 70, as follows:

| Control Signal | Motor 70 | Solenoid 77 | Solonoid 78 |
|---|---|---|---|
| 00 | no motion | not activated | not activated |
| 01 | close valve direction | not activated | activated |
| 10 | open valve direction | activated | not activated |
| 11 | no motion | activated | activated |

The various binary control signals are generated by a control input signal device 80 coupled to the power supply. The device 80 can comprise the input device 151 of FIG. 2. In one embodiment of the invention, the control input signal device 80 comprises a pair of side-by-side proximity switches 81, 82 arranged adjacent to the trigger 12, as illustrated in FIGS. 10*a–d*. The proximity switches 81, 82 can comprise either magnetic or optical proximity switches. The trigger 12 is formed to include an actuator arm 83 mounting an actuator 84 operable to activate one or both of the proximity switches 81, 82 by rotating the trigger 12 to bring the actuator 84 into activating proximity to one or both of the proximity switches 81, 82.

Figure 10B:
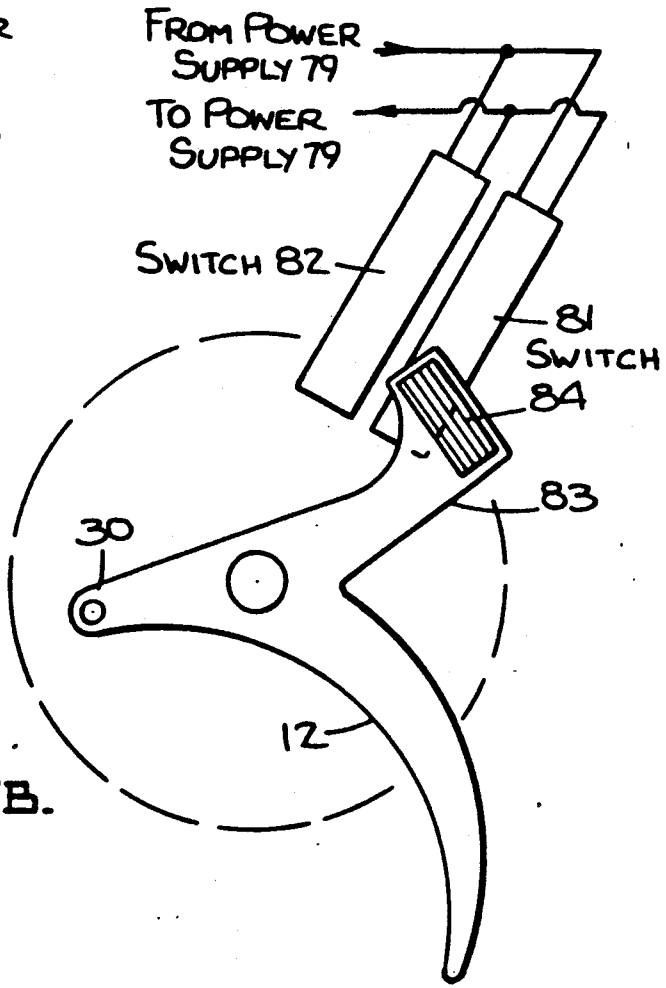
FIGS. 10*a–d* are schematic views of a control signal input device of the valve actuator of FIG. 9 and illustrate several binary logical outputs of a proximity switch arrangement for control of the valve actuator.
Figure 10A:
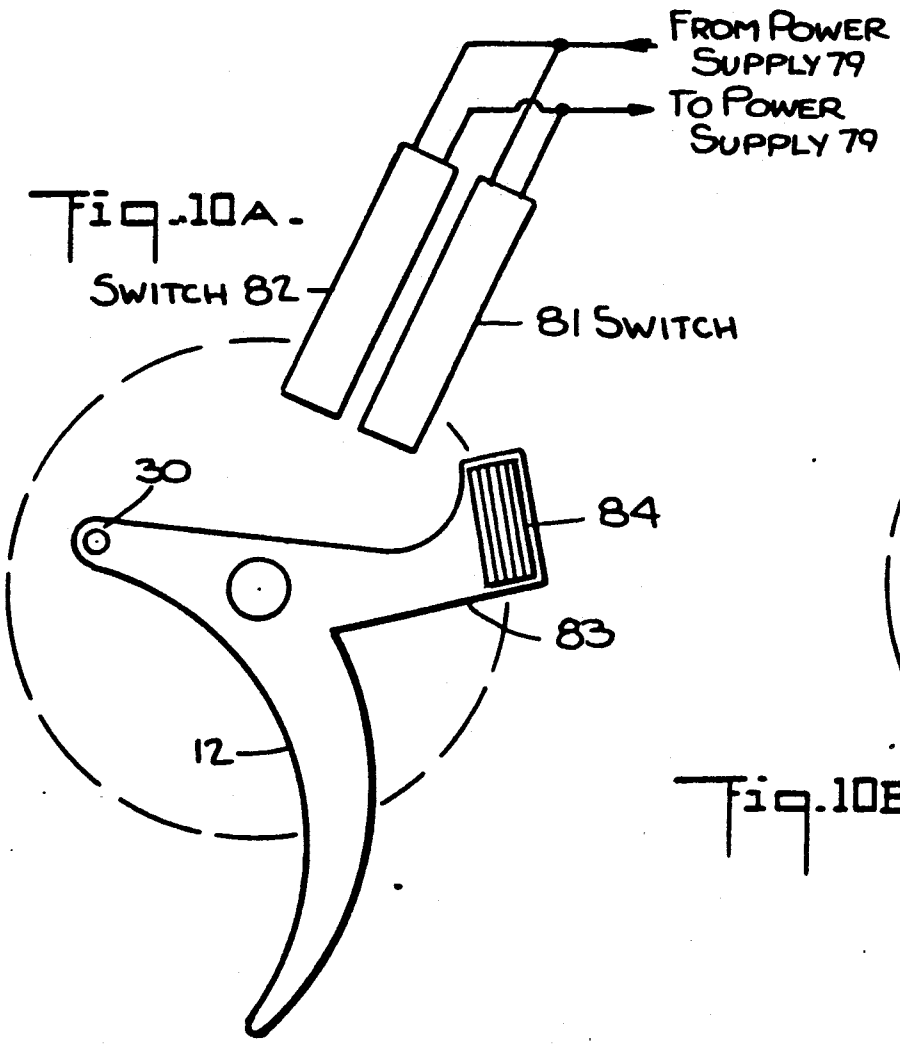

As illustrated in FIG. 10*a*, the trigger is in the closed valve position (see FIG. 1*a*) and the actuator is spaced from both of the proximity switches 81, 82 such that neither one of the proximity switches 81, 82 is activated. This corresponds to the 00 binary input control signal.

In FIG. 10*b*, the trigger 12 is rotated to a position by a user wherein the actuator 84 is in activating proximity to proximity switch 81, but is spaced from activating proximity to proximity switch 82. This corresponds to the 01 binary input control signal.

Figure 10D:
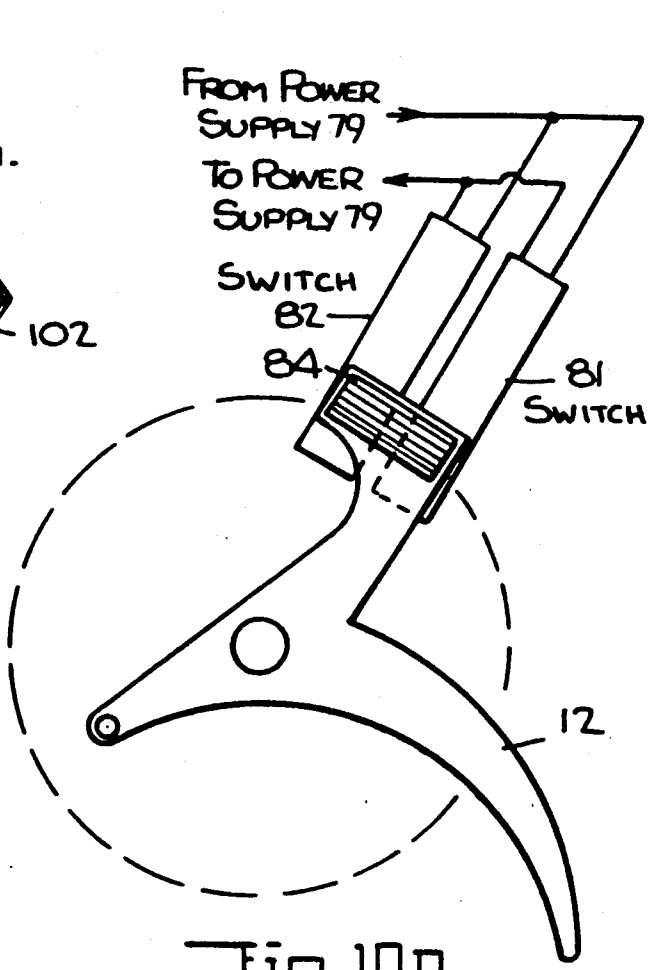
Figure 10C:
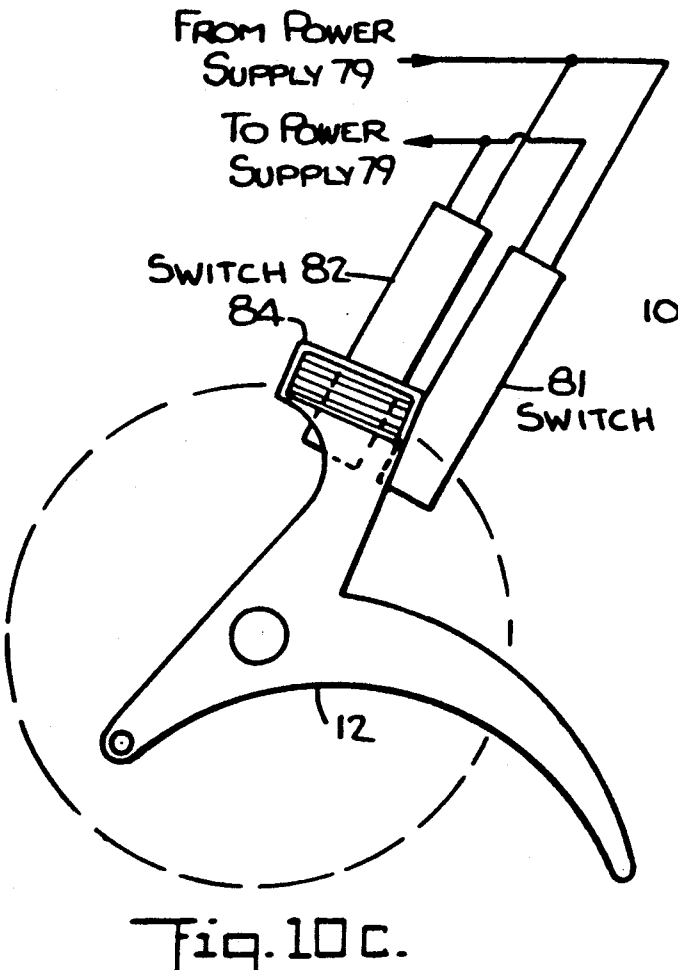

In FIG. 10*c*, the trigger 12 is rotated by a user to a position wherein the actuator 84 is in activating proximity to proximity switch 82, but spaced from activating proximity to proximity switch 81. This corresponds to the 10 binary input control signal.

In FIG. 10*d*, the trigger 12 is rotated by a user to a position wherein the actuator 84 is in activating proximity to both proximity switch 81 and proximity switch 82. This corresponds to the 11 binary input control signal.

Figure 11A:
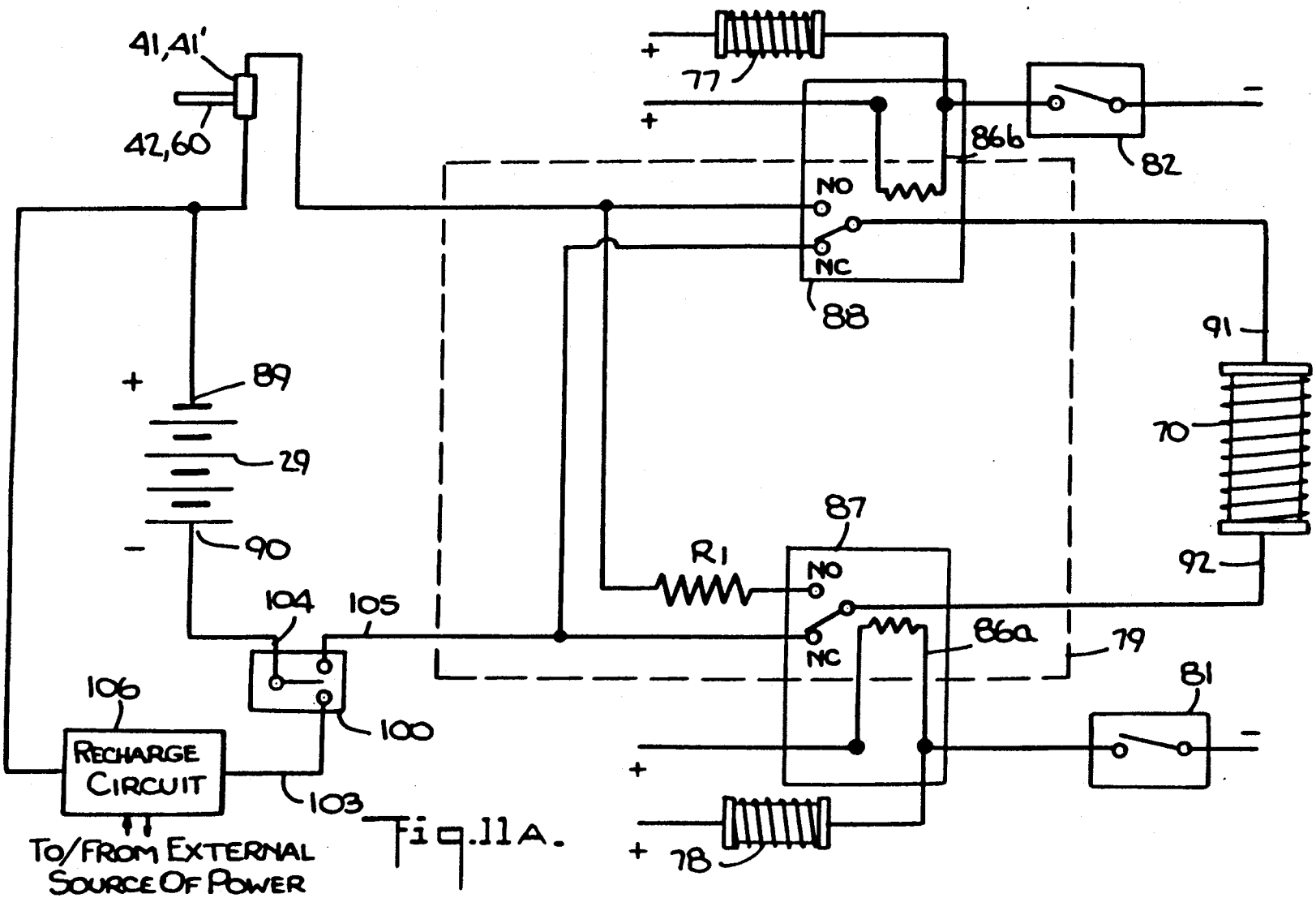
FIGS. 11*a–d* are schematic views of a binary control input signal flow control circuit for the valve actuator of FIG. 9 and illustrate the switch positions pursuant to several different binary input signals.

FIG. 11*a* illustrates an electric schematic of the power supply 79 and control signal input device proximity switches 81, 82 as electrically coupled to the electric drive motor 70, which, in this instance comprises a pull solenoid. Each proximity switch 81, 82 comprises a normally open switch electrically coupled in series with a corresponding SPDT relay 86*a, b* that is arranged within the power supply 79. The power supply 79 includes a source of electric power, such as the D.C. battery 29 which can also be used to provide a source of power to each proximity switch 81, 82 and respective series coupled relay 86*a, b*, as illustrated in FIG. 11*a* by the appropriate + and − symbols. Moreover, each switch 81, 82 is electrically coupled with a respective one of the solenoids 77, 78, with the switch 81 being coupled to the solenoid 78 and the switch 82 being coupled to the solenoid 77.

Each relay 86*a, b* acts as an actuator for a respective double throw switch 87, 88. Each double throw switch 87, 88 includes a normally open contact (NO) and a normally closed contact (NC) wherein the normally open contact is the open switching position of the double throw switch 87, 88 when the respective relay 86*a, b* power is off, i.e. the respective proximity switch 81, 82 is open and the normally closed contact is the closed switching position of the double throw switch 87, 88, also when the respective relay 86*a, b* power is off.

The positive terminal 89 of the D.C. battery 29 is electrically coupled to the normally open contact (NO) of each switch 87, 88 and the negative terminal 90 of the D.C. battery 29 is electrically coupled to the normally closed contact (NC) of each switch 87, 88. A resistor $R_1$ is coupled in series between the positive terminal 89 and the NO contact of switch 87.

A first terminal 91 of the motor 70 is electrically coupled to the switch 88 and a second terminal 92 of the motor 70 is electrically coupled to the switch 87 for coupling through to the D.C. battery 29 through the NC and NO contacts of the switches 87, 88 depending on the switching positions of the proximity switches 81, 82, as will appear.

The transducer pressure switch 41 of FIG. 6 and the corresponding air tube 42 or the optical sensor driven switch 41' of FIG. 7 and the corresponding optical probe 60 can be coupled between the positive terminal 89 of the D.C. battery 29 and the NO contacts of the switches 87, 88 to interrupt power to the motor 70 upon detection of fluid within the spout 15 in a similar manner as in respect of the magnetic clutch embodiment of FIGS. 3*a* and *b*.

Figure 12B:
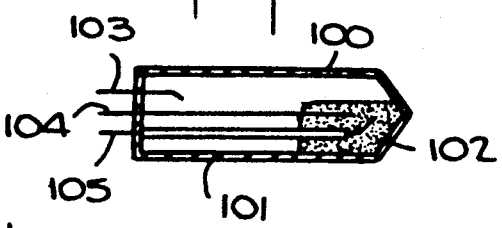
FIGS. 12*a* and *b* illustrate a mercury switch device utilized in the binary input signal flow control circuit of FIGS. 11*a–d*, in the vertical and horizontal positions, respectively.
Figure 12A:
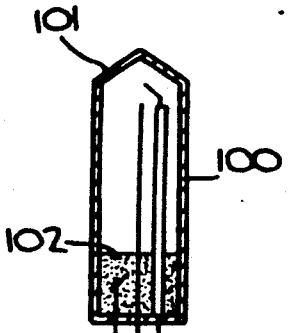

A position sensitive switch, such as, e.g. a mercury switch 100 can also be coupled between the negative terminal 90 of the D.C. battery 29 and the NC contacts of the switches 87, 88 to provide a closed circuit between the D.C. battery 29 and the switches 87, 88 only when the nozzle 10 is in a generally horizontal position, as when the spout 15 of nozzle 10 is inserted into an intake pipe of a motor vehicle fuel tank for dispensing of fluid. As illustrated in FIG. 12*a*, the mercury switch 100 comprises a sealed glass receptacle 101 containing a predetermined amount of mercury 102.

Three electrodes 103, 104, 105 each extend from an external terminal portion to within the receptacle 101 and are positioned within the receptacle 101 in a generally parallel relation to one another. The electrode 103 and the electrode 105 each have a tip portion within the receptacle 101 that is angled with respect to the corresponding electrode 103, 105 and terminates in a spaced but proximate relation to the electrode 104. The spacing between each angled tip portion and the electrode 104 is sufficient to ordinarily provide an open circuit, yet provide a closed circuit when the mercury 102 is between the electrode 104 and either one of the angled tip portions. The amount of mercury 102, as well as the spacial relationship between the electrodes 103, 104, 105 is such that the mercury 102 is between the electrode 103 and the electrode 104 when the mercury switch 100 is in a vertical position, as illustrated in FIG. 12*a*, and is between the electrode 104 and the electrode 105 when the mercury switch 100 is in a horizontal position, as illustrated in FIG. 12*b*.

Accordingly, the electrode 104 can, e.g. be coupled to the negative terminal 90 and the electrode 105 can be coupled to the NC contact of each switch 87, 88 to provide a closed circuit between the D.C. battery 29 and the switches 87, 88 only when the nozzle 10 is in a horizontal position. When the D.C. battery 29 is, e.g. a rechargeable battery, the electrode 103 can couple the rechargeable battery to a recharge circuit 106 when the nozzle is in the vertical position, between each use of the nozzle 10. The recharge circuit 106 is coupled to an external source of power and can be of the type illustrated in FIG. 5*a*. Of course, the rechargeable battery 29 and recharge circuit 106 can be replaced by the optical power supply arrangement depicted in FIG. 5*b*.

As illustrated in FIG. 11*a*, the 00 binary control signal (both proximity switches 81, 82 open (See FIG. 10*a*) results in the negative terminal 90 being electrically coupled to each terminal 91, 92 of the motor 70 through the normally closed contacts NC of the switches 87, 88 and the motor 70 is not energized. Moreover, as indicated in the chart on p. 22, the 00 binary input signal results in each solenoid 77, 78 being in a "not activated" state, i.e. both switches 81, 82 are open, such that the respective springs 76 disengage the levers 73, 74 from the saw-tooth surfaces 71, 72 (See FIG. 9). Accordingly, the spring 51 (FIG. 9) will cause the valve stem 45 to remain in a closed valve position.

Figure 11B:
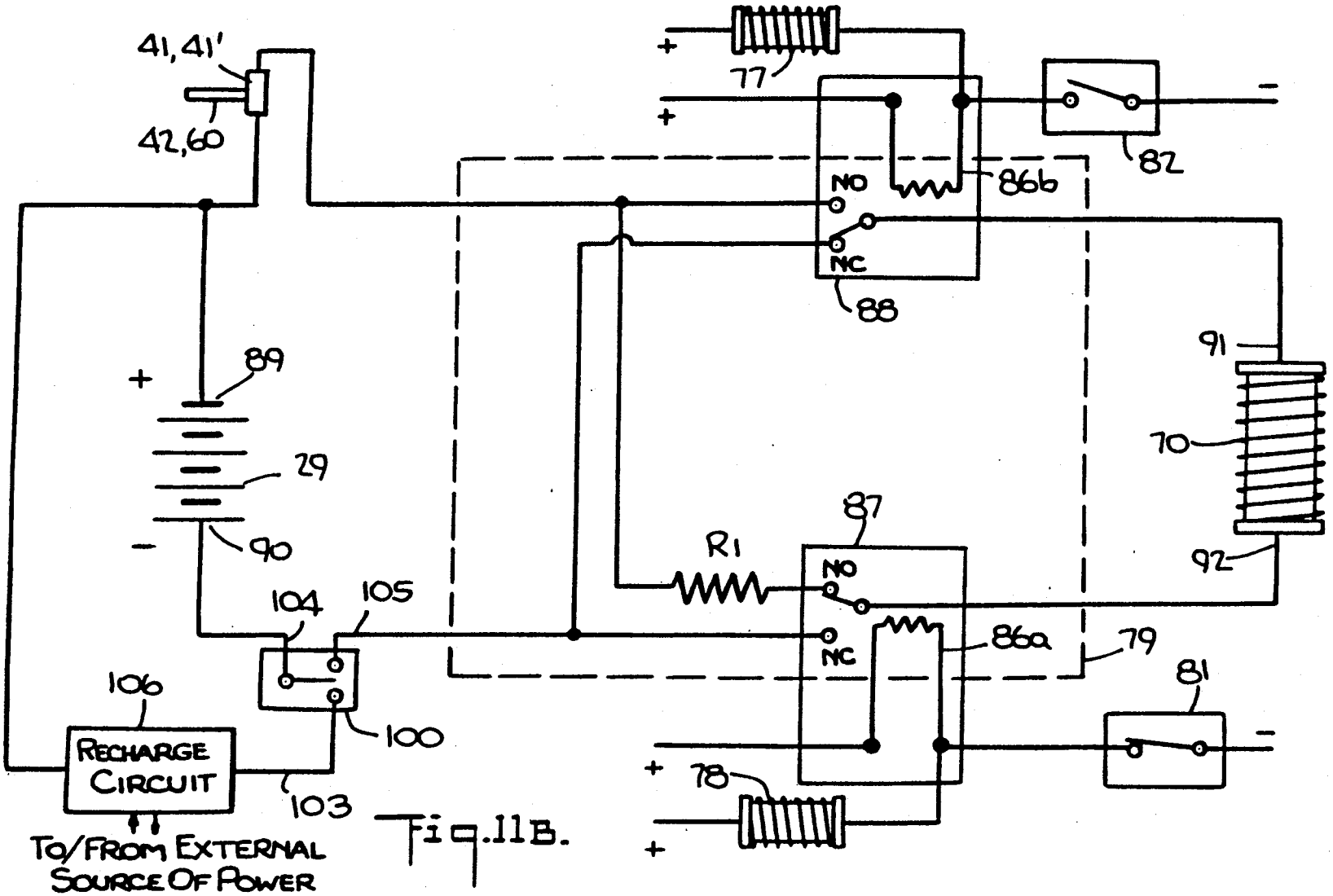

Referring now to FIG. 11*b*, the trigger is rotated to activate switch 81, but is spaced from the switch 82 (see FIG. 10*b*) to provide the 01 binary input signal. Accordingly, switch 81 is closed to energize the relay 86*a* and the solenoid 78. The relay 86*a* causes the double throw switch 87 to change switching position from the NC contact to the NO contact. The double throw switch 88 remains in the NC contact switching position inasmuch as the switch 82 remains open. In this switch configuration, the positive terminal 89 of the D.C. battery 29 is coupled to the terminal 92 of the motor 70 through the resistor $R_1$ and the NO contact of the switch 87 and the negative terminal 90 is coupled to the terminal 91 of the motor 70 through the NC contact of the switch 88, to provide a D.C. voltage potential across the motor 70. The pull solenoid will operate to pull the valve stem 45 away from the valve seat 47 whenever there is a D.C. potential across the terminals 91, 92. However, the resistor $R_1$ decreases the D.C. potential across the solenoid when the 01 binary switch control input signal is applied to reduce the pulling power of the solenoid. The closing force of the spring 51 (see FIG. 9) is sufficient to overcome the reduced pulling power of the solenoid 70 to close the valve. The reduced pulling power of the solenoid is advantageously utilized to provide a smooth, graceful valve closing action by the spring 51.

. Moreover, the 01 binary switch control input signal causes the solenoid 78 to be activated via the now closed switch 81. The solenoid 78 pushes the lever 74 into engagement with the saw-tooth surface 72 that permits the valve stem 45 to move toward the closed valve position, but prevents the stem from moving away from the valve seat 47 (see FIG. 9). As indicated in the chart on page 22, the solenoid 77 is not activated since the switch 82 remains in the open position and the spring 76 disengages the lever 73 from the saw-tooth surface 71.

Figure 11C:
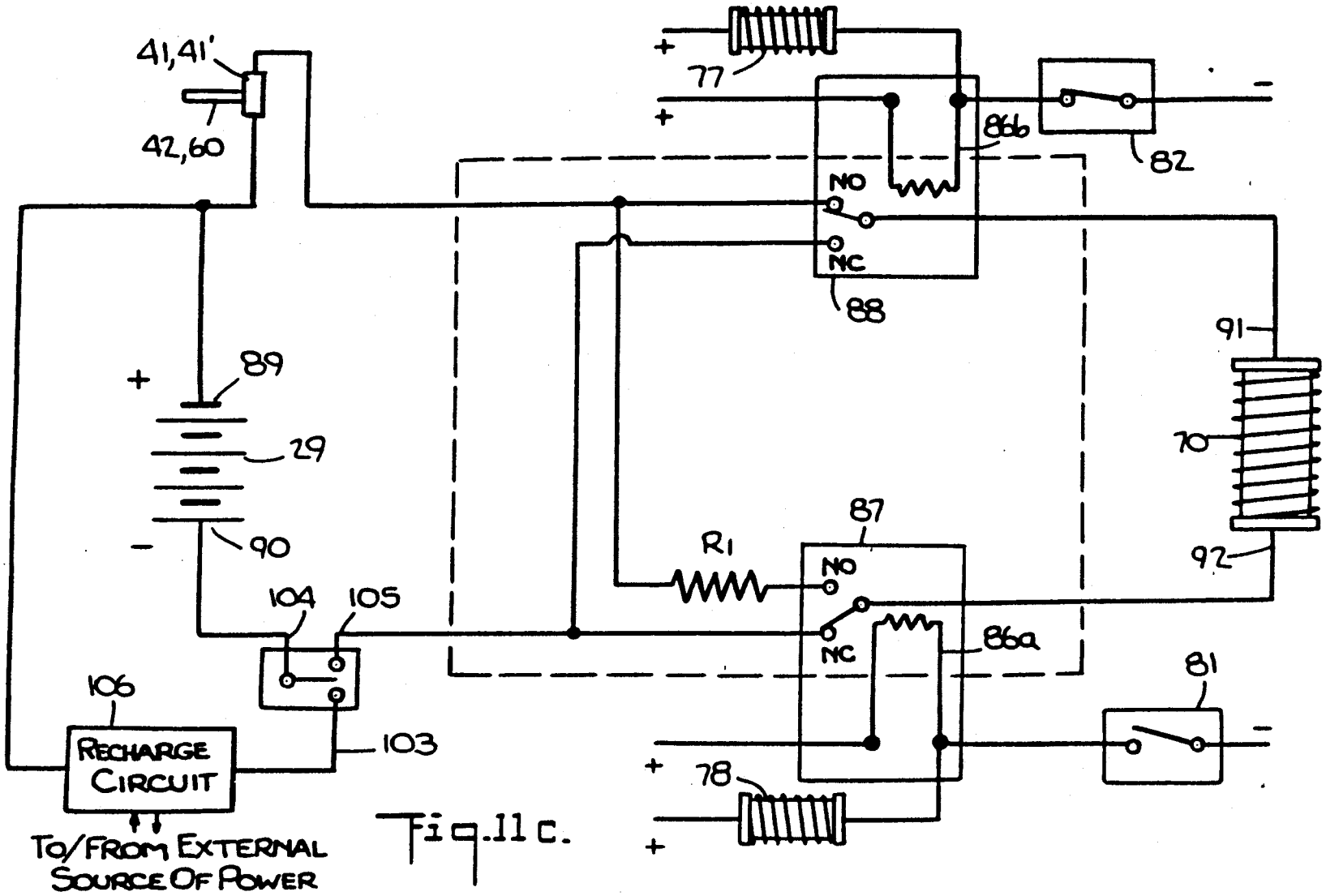

FIG. 11*c* corresponds to the 10 binary switch control input signal wherein the trigger 12 is rotated so that the actuator 84 activates the proximity switch 82 but is spaced from the proximity switch 81 (see FIG. 10*c*). In this position of the trigger 12, the switch 82 is closed to activate the relay 86*b* and the solenoid 77. The relay 86*b* causes the double throw switch 88 to change switching position from the NC contact to the NO contact. In this switch configuration, the positive terminal 89 of the D.C. battery 29 is coupled to the terminal 91 of the motor 70 through the NO contact of the switch 88 and the negative terminal 90 of the D.C. battery 29 is coupled to the terminal 92 of the motor 70 through the NC contact of the switch 87. This again results in a D.C. potential across the motor 70 to provide a solenoid action pulling the valve stem 45 away from the valve seat 47 against the action of the spring 51 (see FIG. 9). However, in the switch configuration of FIG. 10*c*, the full D.C. power is applied across the terminals 91, 92 and the solenoid overcomes the valve closing action of the spring 51.

The activated solenoid 77 pushes the lever 73 into engagement with the saw-tooth surface 71 which permits the valve stem 45 to move away from the valve seat 47, but prevents the valve stem 45 from moving toward the valve seat 47 (see FIG. 9). Of course, the solenoid 78 remains in the not activated state since the switch 81 remains in the open position and the spring 76 disengages the lever 74 from the surface 72.

In this manner, a user can open the in-line flow control valve 21 by rotating the trigger 12 to the position illustrated in FIG. 9*c* and close the valve 21 by releasing the trigger 12 until it is in either of the positions illustrated in FIGS. 9*a* and *b*. In the position of the trigger in FIG. 10*b*, the motor 70 reduces the force of the valve closing action of the spring 51, for a graceful valve closing, while in the position of the trigger in FIG. 9*a*, the spring 51 alone acts to close the valve 21 with its full force.

Figure 11D:
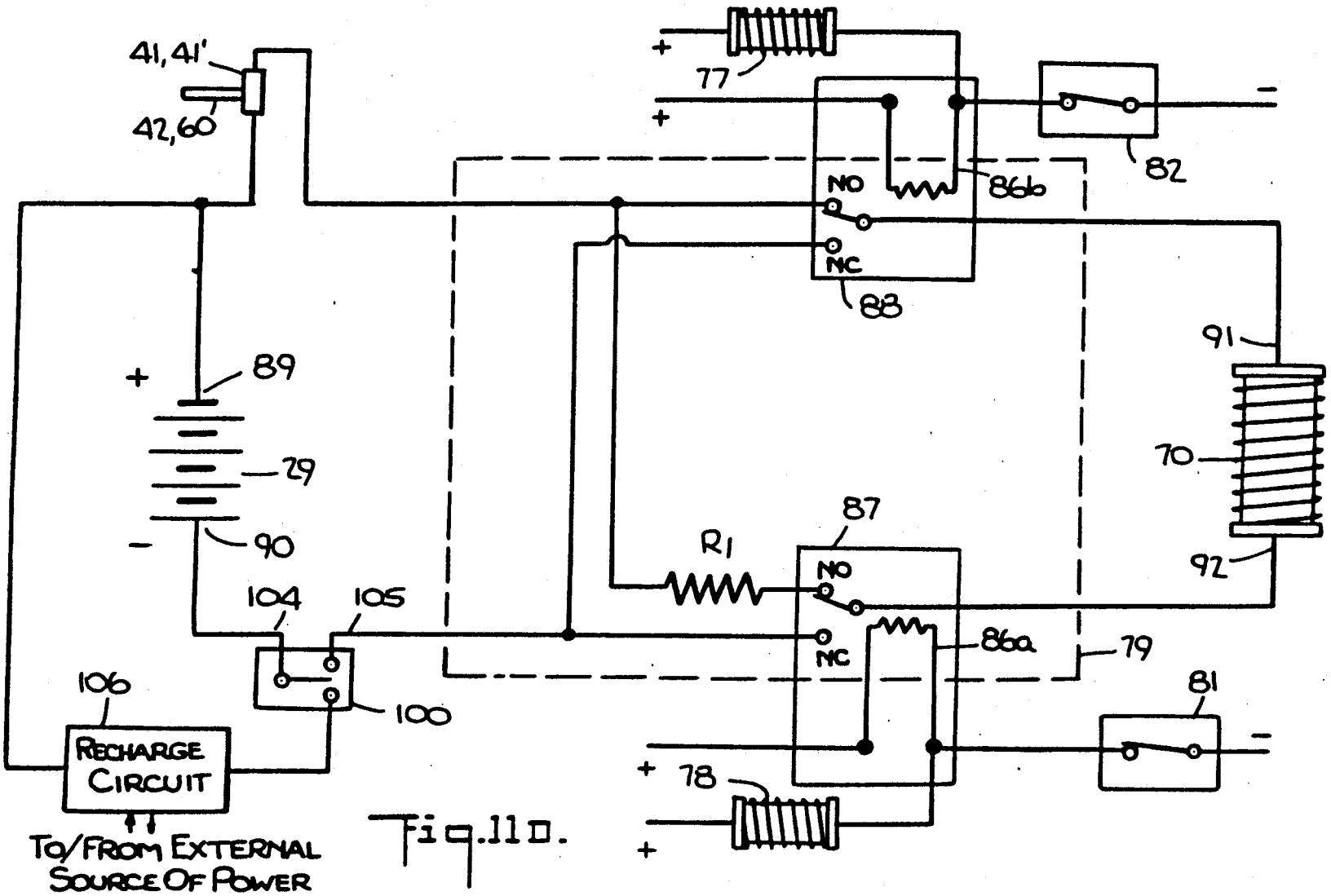

Referring to FIG. 11*d*, there is illustrated the switch configuration under the 11 binary control input signal that corresponds to the trigger position of FIG. 9*d*, which trigger position is midway between the valve opening position of FIG. 10*c* and the valve closing position of FIG. 10*b*. In this configuration, both switches 81, 82 are closed to activate each relay 86*a, b* and each solenoid 77, 78. Thus, each double throw switch 87, 88 is switched to the NO contacts to couple each of the terminals 91, 92 of the motor 70 to the positive terminal 89 of the D.C. battery 29 and the motor 70 is deactivated.

Thus, a user can rotate the trigger 12 to the position of FIG. 10*c* to open the valve 21 until a desired flow rate is achieved and then release the trigger until it is in the position of FIG. 10*d* as the fluid is discharged through the nozzle 10. Power can therefore, be interrupted to the motor 70 during fluid discharge.

However, since each of the solenoids 77, 78 are activated in the 11 binary control input signal switch configuration illustrated in FIG. 11*d*, each lever 73, 74 is pushed into engagement with the respective saw-tooth surface 71, 72 to prevent movement of the valve stem 45 in either the valve closing or valve opening directions and effectively lock the valve stem 45 in place during fluid discharge.

Of course, if the fluid actuated switch device 41, 41' detects the rise of fluid level to within the spout 15, the switch 55, 55' will be opened to interrupt power to all of the components of the valve actuator circuit of FIGS. 11*a–d*, as described above, thereby releasing the levers 73, 74 from engagement with the saw-tooth surfaces 71, 72 and deenergizing the motor 70. The valve stem 45 will then be moved to the closed valve position by the spring 51.

The above-described electrical valve controls enhance the data processing functionality of the nozzle 10 by enabling control of valve actuation and valve shutdown by the meter logic and control device 157 via the switch 165.

What is claimed is:

1. A nozzle to dispense a fluid, which comprises:

a handle element;

a modular housing within said handle element, said modular housing being slidably removable from said handle element, said modular housing including:

a fluid flow passage extending therethrough, and a controllable flow control valve arranged in said fluid flow passage for control of fluid therethrough;

a flow meter arranged to measure a flow of fluid through said fluid flow passage;

an electronic data processing unit mounted in said handle element;

said electronic data processing unit including a data input port coupled to said flow meter for input of data indicative of fluid flow through said nozzle, wherein when said modular housing is slidably removed from said handle element, each of said flow control valve, said fluid flow meter, and said fluid flow passage remain with said modular housing and said electronic data processing unit remains with said handle element.

2. The nozzle of claim 1 further comprising a communication interface unit mounted in said handle element and being coupled to said electronic data processing unit; and a communication line coupled to said communication interface unit.

3. The nozzle of claim 1 further comprising:

an electrically actuated control device mounted in said handle element and coupled to said flow control valve;

a control switch coupled to said electrically actuated control device;

said data processing unit being coupled to said control switch for control thereof to selectively actuate and deactuate said electrically actuated control device for control of said controllable flow control valve.

4. The nozzle of claim 1 further comprising a display device mounted to said handle element and coupled to said data processing unit for display of information output by said data processing unit.

5. The nozzle of claim 1 further comprising an interactive input device mounted to said handle element and coupled to said data processing unit.

6. The nozzle of claim 5 wherein said interactive input device comprises a key pad mounted on said handle element.

7. The nozzle of claim 1 further comprising a magnetic card reader mounted on said handle element and coupled to said data processing unit.

8. The nozzle of claim 1 further comprising a power supply means mounted in said handle element and coupled to said electronic data processing unit.

9. The nozzle of claim 8 wherein said power supply means is a rechargeable battery and further comprising:

a recharge circuit mounted in said handle element and coupled to said rechargeable battery; and a source of electrical power external to said handle element and magnetically coupled to said recharge circuit.

10. The nozzle of claim 1 further comprising an optical-to-electrical power converter mounted in said handle element and coupled to said electronic data processing unit;

an optical cable coupled to said optical-to-electrical power converter for input of optical power, said optical cable extending from said handle; and a source of optical power external to said handle element coupled to said optical cable.

11. A nozzle to dispense fluid comprising:

a handle element;

a modular housing within said handle element, said modular housing being slidably removable from said handle element, said modular housing including;

a fluid flow passage extending therethrough, and a controllable flow control valve arranged in said fluid flow passage for control of fluid therethrough;

en electronic data processing unit within said nozzle; and an electronic display unit mounted on said nozzle for displaying data derived from said electronic data processing unit, wherein when said modular housing is slidably removed from said handle element each of said flow control valve and said fluid flow passage remain with said modular housing and said electronic data processing unit and said electronic display unit remain with said handle element.

12. The nozzle of claim 11 further comprising a flow meter and wherein said displayed data is derived from fluid flow within said nozzle.

* * * * *